US011286945B2

(12) United States Patent
Ishii et al.

(10) Patent No.: US 11,286,945 B2
(45) Date of Patent: Mar. 29, 2022

(54) TURBOFAN AND METHOD OF MANUFACTURING TURBOFAN

(71) Applicant: DENSO CORPORATION, Aichi-pref. (JP)

(72) Inventors: Fumiya Ishii, Kariya (JP); Shuzo Oda, Kariya (JP)

(73) Assignee: DENSO CORPORATION, Aichi-pref. (JP)

( * ) Notice: Subject to any disclaimer, the term of this patent is extended or adjusted under 35 U.S.C. 154(b) by 360 days.

(21) Appl. No.: 15/777,041

(22) PCT Filed: Oct. 20, 2016

(86) PCT No.: PCT/JP2016/081098

§ 371 (c)(1),
(2) Date: May 17, 2018

(87) PCT Pub. No.: WO2017/090347

PCT Pub. Date: Jun. 1, 2017

(65) Prior Publication Data

US 2018/0328376 A1 Nov. 15, 2018

(30) Foreign Application Priority Data

Nov. 23, 2015 (JP) ..... JP2015-228267

(51) Int. Cl.
*F04D 29/30* (2006.01)
*F04D 29/28* (2006.01)
(Continued)

(52) U.S. Cl.
CPC ..... *F04D 29/281* (2013.01); *F04D 25/06* (2013.01); *F04D 25/064* (2013.01); *F04D 29/30* (2013.01); *F04D 29/626* (2013.01); *F04D 17/16* (2013.01)

(58) Field of Classification Search
CPC ..... F04D 25/0613; F04D 25/062; F04D 25/0626; F04D 25/0633; F04D 25/064;
(Continued)

(56) References Cited

U.S. PATENT DOCUMENTS 4,263,842 A * 4/1981 Moore ..... F24F 13/15 454/318
4,647,271 A * 3/1987 Nagai ..... F04D 29/281 416/186 R
(Continued)

FOREIGN PATENT DOCUMENTS

CN 1932301 A 3/2007
CN 102395795 A 3/2012
(Continued)

OTHER PUBLICATIONS

U.S. Appl. No. 15/777,006, filed May 18, 2018, Ishii et al..

*Primary Examiner* — Bryan M Lettman
*Assistant Examiner* — Dnyanesh G Kasture
(74) *Attorney, Agent, or Firm* — Harness, Dickey & Pierce, P.L.C.

(57) ABSTRACT

A fan main body member of a turbofan has multiple blades disposed around a fan axial center, a shroud ring which is coupled to each of the multiple blades, and a fan hub portion which is coupled to each of the multiple blades on a side opposite from the shroud ring. An other end side plate of the turbofan is fitted to the radially outer side of the fan hub portion and joined to an other side blade end portions of each of the multiple blades. In addition, an outer diameter of the fan hub portion is smaller than an inner diameter of the shroud ring. In addition, the multiple blades, the shroud ring, and the fan hub portion are integrally formed.

8 Claims, 10 Drawing Sheets

(51) Int. Cl.
*F04D 29/62* (2006.01)
*F04D 25/06* (2006.01)
*F04D 17/16* (2006.01)

(58) Field of Classification Search
CPC .. F04D 25/0646; F04D 29/281; F04D 29/626; F04D 25/06; F04D 29/30; F04D 17/16
See application file for complete search history.

(56) References Cited

U.S. PATENT DOCUMENTS

| | | | | | |
|---|---|---|---|---|---|
| 5,152,711 | A * | 10/1992 | Gross | A63H 33/046 | 211/69.1 |
| 5,395,071 | A * | 3/1995 | Felix | B64C 3/14 | 244/200 |
| 2004/0212262 | A1* | 10/2004 | Chiu | H02K 7/14 | 310/91 |
| 2007/0128052 | A1* | 6/2007 | Moriya | F04D 25/0613 | 417/354 |
| 2008/0118357 | A1 | 5/2008 | Jeon et al. | | |
| 2013/0028720 | A1* | 1/2013 | Fujimoto | F04D 29/4246 | 415/203 |
| 2014/0205476 | A1* | 7/2014 | Kudo | F04D 29/083 | 417/354 |

FOREIGN PATENT DOCUMENTS

| | | | | |
|---|---|---|---|---|
| GB | 750305 | A * | 6/1956 | F04D 29/324 |
| JP | S61021593 | Y2 | 6/1986 | |
| JP | H06015875 | B2 | 3/1994 | |
| JP | 2008128232 | A | 6/2008 | |
| JP | 4317676 | B2 | 8/2009 | |

* cited by examiner

TURBOFAN AND METHOD OF MANUFACTURING TURBOFAN

CROSS REFERENCE TO RELATED APPLICATIONS

This application is a U.S. National Phase Application under 35 U.S.C. 371 of International Application No. PCT/JP2016/081098 filed on Oct. 20, 2016 and published in Japanese as WO 2017/090347 A1 on Jun. 1, 2017. This application is based on and claims the benefit of priority from Japanese Patent Application No. 2015-228267 filed on Nov. 23, 2015. The entire disclosures of all of the above applications are incorporated herein by reference.

TECHNICAL FIELD

The present disclosure relates to a turbofan applied to a blower and a method of manufacturing the turbofan.

BACKGROUND ART

For example, Patent Literature 1 discloses a turbofan included in conventional art. The turbofan disclosed in Patent Literature 1 is a fan for an air conditioner. Specifically, the turbofan of Patent Literature 1 is a closed turbofan in which blades are surrounded by a shroud ring and a main plate among various turbofans.

In the turbofan of Patent Literature 1, among three components including the shroud ring (that is, side plate), multiple blades, and a fan main body including a fan hub portion and a main plate, which are standard components of a closed turbofan, the fan main body and the blade are integrally molded. In addition, the shroud ring is molded as a separate component from the fan main body. The turbofan of Patent Literature 1 is formed by joining the shroud ring to the fan main body. Furthermore, in the turbofan of Patent Literature 1, weldability when joining the shroud ring to the fan main body is improved.

PRIOR ART LITERATURE

Patent Literature

Patent Literature 1: JP 4317676 B

SUMMARY OF INVENTION

For closed turbofans, with a simple die structure in which an extraction direction of the die is the axial direction of the turbofan, not limited to the turbofan of Patent Literature 1, all of the above-described three components that form the closed turbofan cannot be integrally molded.

Therefore, in a typical closed turbofan in the conventional art, the three components, that is, the shroud ring, the multiple blades, and the fan main body are molded separately. Then, after the molding, the closed turbofan is completed by joining the components to each other. This is a typical manufacturing method in the conventional art.

Here, the turbofan is stored and used between two case members. In addition, one of the phenomena generated in the turbofan is that the air passes between the case member on the shroud ring side and the shroud ring among the two case members, and flows backward. Since the air pressure at a blade front edge of the turbofan is large on the negative pressure side, the air blown out from a fan outlet portion flows backward.

Meanwhile, in order to improve the performance of the turbofan, it is necessary to restrict a flow rate of the air that flows backward. In addition, the flow rate of the backward flowing air is restricted to be small as a clearance between the case member on the shroud ring side and the shroud ring is reduced. However, in the turbofan described above as the conventional art, that is, the turbofan in which the fan main body and the shroud ring are separately molded, due to causes such as a joining play (for example, misalignment) between the shroud ring and the fan main body, rotational shake of the shroud ring with respect to the fan rotation axis increases. This is because the fan rotating shaft is coupled to the fan main body and indirectly supports the shroud ring via the fan main body and the blade.

In addition, since the fan main body and the shroud ring are also separately molded in the turbofan of Patent Literature 1, the above described rotational shake of the shroud ring has not been solved.

From this viewpoint, in a turbofan which is the above-described conventional art, since the rotational shake of the shroud ring with respect to the fan rotational axis increases to some extent, for the purpose of preventing interference between the shroud ring and the case member, the inventor discovered that it is necessary to increase the clearance. In other words, in order to prevent the interference between the shroud ring and the case member, the inventor discovered that it is not possible to sufficiently restrict the flow rate of the air that flows backwards through the clearance between the shroud ring and the case member, and as a result, the performance of the turbofan deteriorates.

From this viewpoint, an object of the present disclosure is to provide a turbofan which is capable of easily restricting rotational shake of a shroud ring with respect to a fan axial center as compared with the turbofan of Patent Literature 1, and a method of manufacturing the turbofan.

To achieve the above object(s), according to one aspect of the present disclosure, a turbofan of the present disclosure is a turbofan applied to a blower and which blows air rotating about a fan axial center, and includes a fan main body member including a plurality of blades disposed around the fan axial center, a shroud ring having formed therein an intake hole into which air is suctioned, the shroud ring being provided on one side in an axial direction of the fan axial center with respect to the plurality of blades and being coupled to each of the plurality of blades, and a fan hub portion which is supported so as to be rotatable about the fan axial center with respect to a non-rotating member of the blower and which is coupled to each of the plurality of blades on a side opposite from the shroud ring side, and an other end side plate that, in a state of being fitted to a radially outer side of the fan hub portion, is joined to an other side blade end portion included in each of the plurality of blades, the other side blade end portions of the plurality of blades being on an other side which is opposite to the one side in the axial direction, where an outer diameter of the fan hub portion is smaller than an inner diameter of the shroud ring, and the plurality of blades, the shroud ring, and the fan hub portion are integrally formed.

As described above, the multiple blades, the shroud ring, and the fan hub portion are integrally formed, and the outer diameter of the fan hub portion is smaller than the inner diameter of the shroud ring. Accordingly, the multiple blades, the shroud ring, and the fan hub portion can be easily integrally molded with the axial direction of the fan axial center as a releasing direction (that is, an opening and closing direction of the dies) of the dies. In addition, since the other end side plate is joined to each of the other side blade end portions of the multiple blades in a state of being fitted to the radially outer side of the fan hub portion, the turbofan can be completed by assembling the other end side plate to the fan main body member after molding the fan main body member. Therefore, as a result of the integral molding of the shroud ring and the fan hub portion, rotational shake of the shroud ring with respect to the fan axial center when the turbofan is rotated can be easily restricted as compared with the turbofan of Patent Literature 1.

Further, according to another aspect of the present disclosure, a method of manufacturing a turbofan according to the present disclosure is a method of manufacturing a turbofan which is applied to a blower and which blows air by rotating about a fan axial center, and includes integrally forming a plurality of blades disposed around the fan axial center, a shroud ring having formed therein an intake hole into which air is suctioned, the shroud ring being provided on one side in an axial direction of the fan axial center with respect to the plurality of blades and being coupled to each of the plurality of blades, and a fan hub portion which is supported so as to be rotatable about the fan axial center with respect to a non-rotating member of the blower and which is coupled to each of the plurality of blades on a side opposite from the shroud ring side, and after the integral molding, fitting an other end side plate having an annular shape to a radially outer side of the fan hub portion, and joining the other end side plate to each of an other side blade end portions included in each of the plurality of blades, the other side blade end portions of the plurality of blades being on an other side which is opposite to the one side in the axial direction.

As described above, after integrally molding the multiple blades, the shroud ring, and the fan hub portion, the other end side plate having an annular shape is fitted to the radially outer side of the fan hub portion, and the other end side plates are joined to each of the other side blade end portions of the multiple blades. Therefore, similar to the turbofan according to the above-described aspect, rotational shake of the shroud ring with respect to the fan axial center when the turbofan is rotated can be easily restricted as compared with the turbofan of Patent Literature 1.

DESCRIPTION OF EMBODIMENTS

Figure 1:
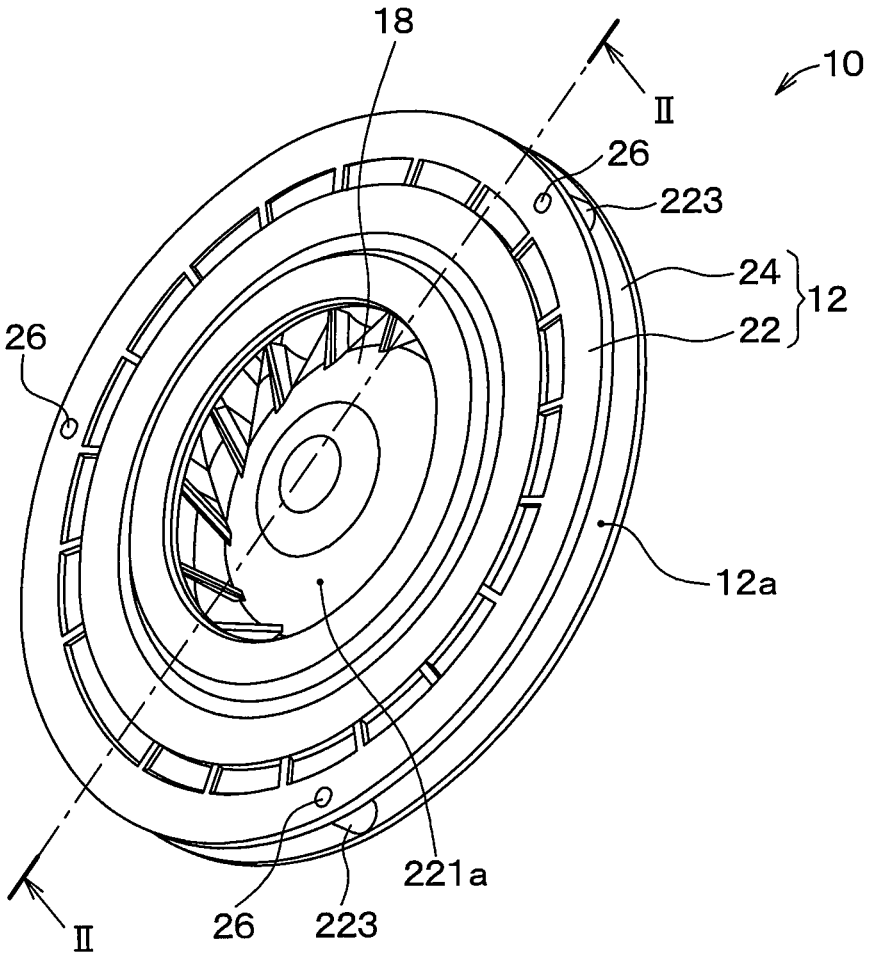
FIG. 1 is a perspective view illustrating an appearance of a blower in a first embodiment.

Hereinafter, embodiments of the present disclosure will be described with reference to the drawings. In addition, the same reference numerals are attached to the same or equivalent portions in each of the following embodiments including other embodiments described later.

First Embodiment

Figure 2:
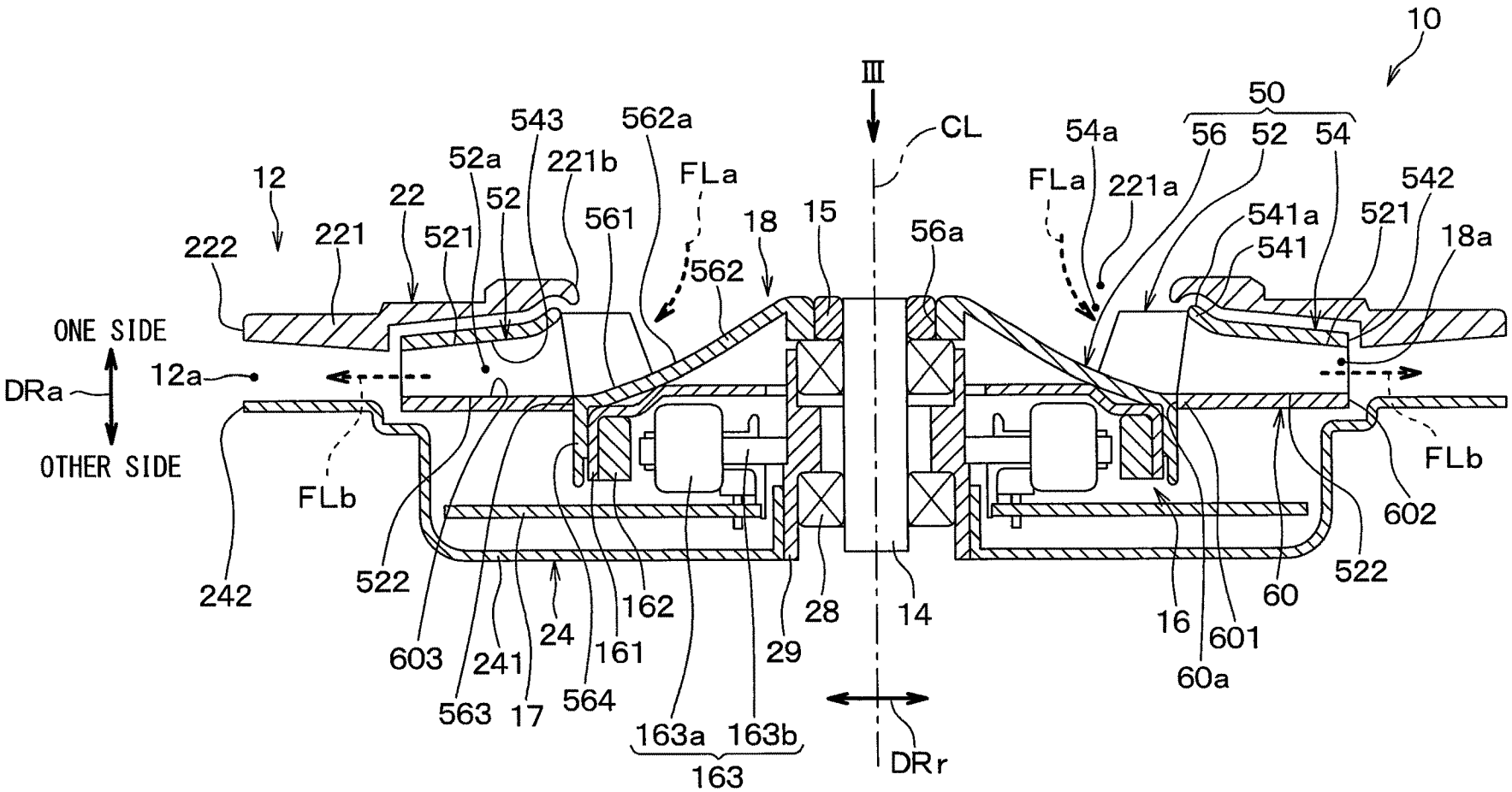
FIG. 2 is an axial cross-sectional view of the blower taken along a plane including a fan axial center, that is, a cross-sectional view taken along line II-II of FIG. 1.

FIG. 1 is a perspective view illustrating an appearance of a blower 10 in a first embodiment. In addition, FIG. 2 is an axial cross-sectional view of the blower 10 taken along a plane including a fan axial center CL, that is, a cross-sectional view taken along line II-II of FIG. 1. An arrow DRa in FIG. 2 indicates an axial direction DRa of the fan axial center CL, that is, a fan axial center direction DRa. In addition, an arrow DRr in FIG. 2 indicates a radial direction DRr of the fan axial center CL, that is, a fan radial direction DRr.

As illustrated in FIGS. 1 and 2, the blower 10 is a centrifugal blower, specifically, a turbo type blower. The blower 10 includes a casing 12, a rotating shaft 14, a rotating shaft housing 15, an electric motor 16, an electronic board 17, a turbofan 18, a bearing 28, a bearing housing 29 and the like which are housings of the blower 10.

The casing 12 protects the electric motor 16, the electronic board 17, and the turbofan 18 from dust and dirt on the outer side of the blower 10. Therefore, the casing 12 accommodates the electric motor 16, the electronic board 17, and the turbofan 18. In addition, the casing 12 includes a first case member 22 and a second case member 24.

The first case member 22 is made of resin, for example, and has a diameter larger than that of the turbofan 18 and has a substantially disk shape. The first case member 22 includes a first cover portion 221, a first circumferential edge portion 222, and multiple supports 223.

The first cover portion 221 is disposed on one side in the fan axial center direction DRa with respect to the turbofan 18 and covers one side of the turbofan 18. Here, covering the turbofan 18 is to cover at least a portion of the turbofan 18.

An air suction port 221*a* which penetrates the first cover portion 221 in the fan axial center direction DRa is provided on the inner circumferential side of the first cover portion 221, and the air is suctioned to the turbofan 18 through the air suction port 221*a*. In addition, the first cover portion 221 has a bell mouth portion 221*b* that forms a circumferential edge of the air suction port 221*a*. The bell mouth portion 221*b* smoothly guides the air that flows from the outer side of the blower 10 to the air suction port 221*a* into the air suction port 221*a*.

As illustrated in FIGS. 1 and 2, the first circumferential edge portion 222 forms a circumferential edge of the first case member 22 around the fan axial center CL. Each of the multiple supports 223 protrudes from the first cover portion 221 to the inside of the casing 12 in the fan axial center direction DRa. In addition, the support 223 has a thick cylindrical shape having a central axis parallel to the fan axial center CL. A screw hole through which a screw 26 that bonds the first case member 22 and the second case member 24 is inserted is provided on the inside of the support 223.

Each of the supports 223 of the first case member 22 is disposed on the outer side of the turbofan 18 in the fan radial direction DRr. In addition, the first case member 22 and the second case member 24 are joined by the screw 26 inserted into the support 223 in a state where a tip end of the support 223 abuts against the second case member 24.

The second case member 24 has a substantially disk shape having substantially the same diameter as that of the first case member 22. The second case member 24 is made of metal, such as iron or stainless steel, or resin, and also functions as a motor housing for covering the electric motor 16 and the electronic board 17. The second case member 24 includes a second cover portion 241 and a second circumferential edge portion 242.

The second cover portion 241 is disposed on another side in the fan axial center direction DRa with respect to the turbofan 18 and the electric motor 16, and covers the other side of the turbofan 18 and the electric motor 16. The second circumferential edge portion 242 forms the circumferential edge of the second case member 24 around the fan axial center CL.

The first circumferential edge portion 222 and the second circumferential edge portion 242 form an air blowing portion for blowing the air in the casing 12. In addition, the first circumferential edge portion 222 and the second circumferential edge portion 242 are provided between the first circumferential edge portion 222 and the second circumferential edge portion 242 in the fan axial center direction DRa such that an air outlet 12*a* for blowing out the air blown out from the turbofan 18 is provided.

Specifically, the air outlet 12*a* is provided on a fan side surface of the blower 10, and opens over the entire circumference of the casing 12 around the fan axial center CL and blows out the air from the turbofan 18. In addition, since the air blowing out from the casing 12 is obstructed by the support 223 at the location where the support 223 is provided, a case where the air outlet 12*a* is open over the entire circumference of the casing 12 has a meaning including a case where the air outlet 12*a* is open substantially over the entire circumference.

Each of the rotating shaft 14 and the rotating shaft housing 15 is made of a metal, such as iron, stainless steel, or brass. As illustrated in FIG. 2, the rotating shaft 14 is a columnar bar member and pressed-fitted into the rotating shaft housing 15 and an inner ring of the bearing 28, respectively. Therefore, the rotating shaft housing 15 is fixed to the rotating shaft 14 and the inner ring of the bearing 28. Further, an outer ring of the bearing 28 is fixed by press-fitting or the like to the bearing housing 29. The bearing housing 29 is made of a metal, such as aluminum alloy, brass, iron, or stainless steel, for example, and is fixed to the second cover portion 241.

Therefore, the rotating shaft 14 and the rotating shaft housing 15 are supported via the bearing 28 with respect to the second cover portion 241. In other words, the rotating shaft 14 and the rotating shaft housing 15 are rotatable about the fan axial center CL with respect to the second cover portion 241.

At the same time, the rotating shaft housing 15 is fitted into an inner circumferential hole 56*a* of a fan hub portion 56 of the turbofan 18 in the casing 12. For example, the rotating shaft 14 and the rotating shaft housing 15 are insert-molded in a fan main body member 50 of the turbofan 18 in a state where the rotating shaft 14 and the rotating shaft housing 15 are mutually fixed in advance. Accordingly, the rotating shaft 14 and the rotating shaft housing 15 are coupled to the fan hub portion 56 of the turbofan 18 so as to be relatively non-rotatable. In other words, the rotating shaft 14 and the rotating shaft housing 15 rotate integrally with the turbofan 18 about the fan axial center CL.

The electric motor 16 is an outer rotor type brushless DC motor. The electric motor 16 together with the electronic board 17 is disposed between the fan hub portion 56 of the turbofan 18 and the second cover portion 241 in the fan axial center direction DRa. In addition, the electric motor 16 includes a motor rotor 161, a rotor magnet 162, and a motor stator 163. The motor rotor 161 is made of a metal, such as a steel plate, and for example, a motor rotor 161 is provided by press-forming the steel plate.

The rotor magnet 162 is a permanent magnet, and is made of a rubber magnet containing ferrite, neodymium, or the like. The rotor magnet 162 is integrally fixed to the motor rotor 161. Further, the motor rotor 161 is fixed to the fan hub portion 56 of the turbofan 18. In other words, the motor rotor 161 and the rotor magnet 162 rotate integrally with the turbofan 18 about the fan axial center CL.

The motor stator 163 includes a stator coil 163*a* and a stator core 163*b* which are electrically connected to the electronic board 17. The motor stator 163 is disposed on a radially inner side with a minute gap from the rotor magnet 162. In addition, the motor stator 163 is fixed to the second cover portion 241 of the second case member 24 via the bearing housing 29.

In the electric motor 16 configured in this manner, when the stator coil 163*a* of the motor stator 163 is electrically conducted from an external power source, a change in magnetic flux is generated in the stator core 163*b* by the stator coil 163*a*. In addition, the change in magnetic flux in the stator core 163*b* generates a force which pulls the rotor magnet 162. Since the motor rotor 161 is fixed to the rotating shaft 14 which is rotatably supported by the bearing 28, the motor rotor 161 receives the force which pulls the rotor magnet 162 and performs a rotational motion about the fan axial center CL. In other words, the electric motor 16 is electrically conducted to rotate the turbofan 18, to which the motor rotor 161 is fixed, about the fan axial center CL.

Figure 3:
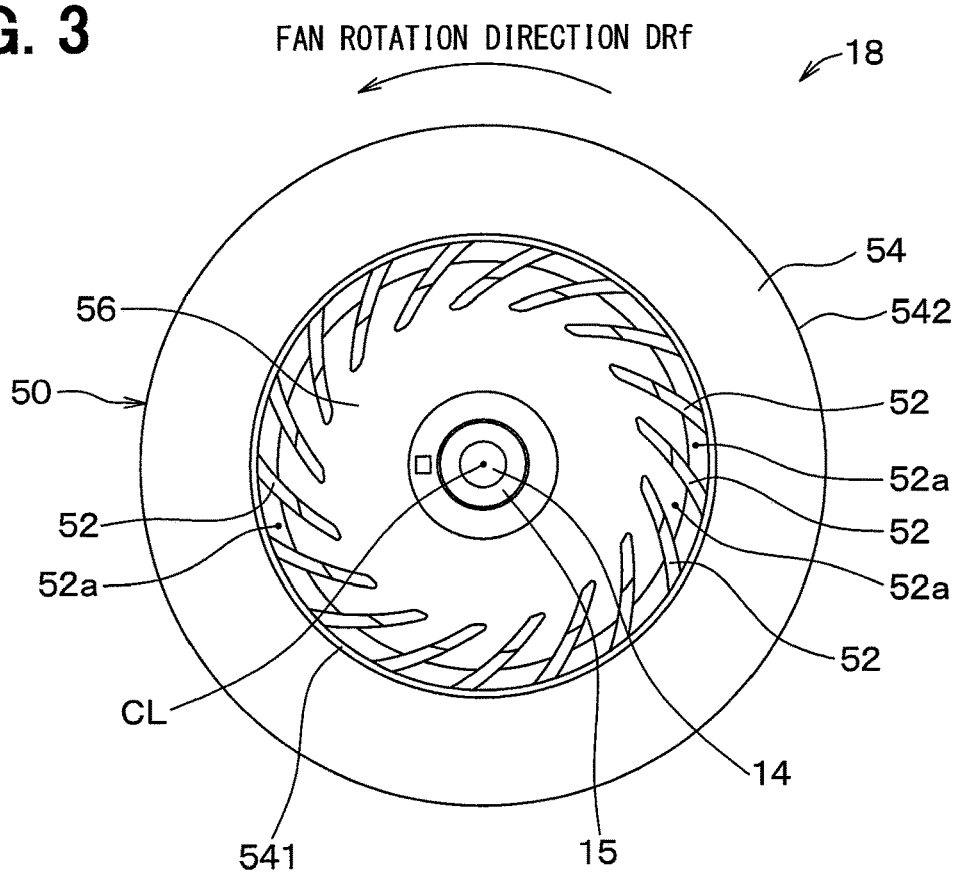
FIG. 3 is a view illustrating a turbofan, a rotating shaft, and a rotating shaft housing extracted from the view taken in the direction of an arrow III in FIG. 2.

As illustrated in FIGS. 2 and 3, the turbofan 18 is an impeller applied to the blower 10. The turbofan 18 rotates about the fan axial center CL in a predetermined fan rotation direction DRf to blow the air. In other words, as the turbofan 18 rotates about the fan axial center CL, the air is suctioned from one side in the fan axial center direction DRa as indicated by an arrow FLa via the air suction port 221*a*. In addition, the turbofan 18 blows out the suctioned air as indicated by an arrow FLb to the outer circumferential side of the turbofan 18.

Specifically, the turbofan 18 of the present embodiment has the fan main body member 50 and an other end side plate 60. In addition, the fan main body member 50 includes multiple blades 52, a shroud ring 54, and a fan hub portion 56. The fan main body member 50 is made of a resin, for example, and is provided by one injection molding. Therefore, the multiple blades 52, the shroud ring 54, and the fan hub portion 56 are integrally formed, and any of the multiple blades 52, the shroud ring 54, and the fan hub portion 56 is also formed of a resin similar to the fan main body member 50. In other words, since the fan main body member 50 is an integrally molded product, there is no joining portion for joining both of the multiple blades 52 and the shroud ring 54 to each other by welding or the like. In addition, between the multiple blades 52 and the fan hub portion 56, there is no joining portion for joining the multiple blades 52 and the fan hub portion 56 to each other by welding or the like.

The multiple blades 52 are disposed around the fan axial center CL. Specifically, the multiple blades 52, that is, the fan blades 52 are disposed in parallel in the circumferential direction of the fan axial center CL with an interval at which the air flows between the blades.

In addition, each of the blades 52 includes a one side blade end portion 521 provided on the one side in the fan axial center direction DRa of the blade 52, and an other side blade end portion 522 provided on the other side opposite to the one side in the fan axial center direction DRa of the blade 52.

Figure 4:
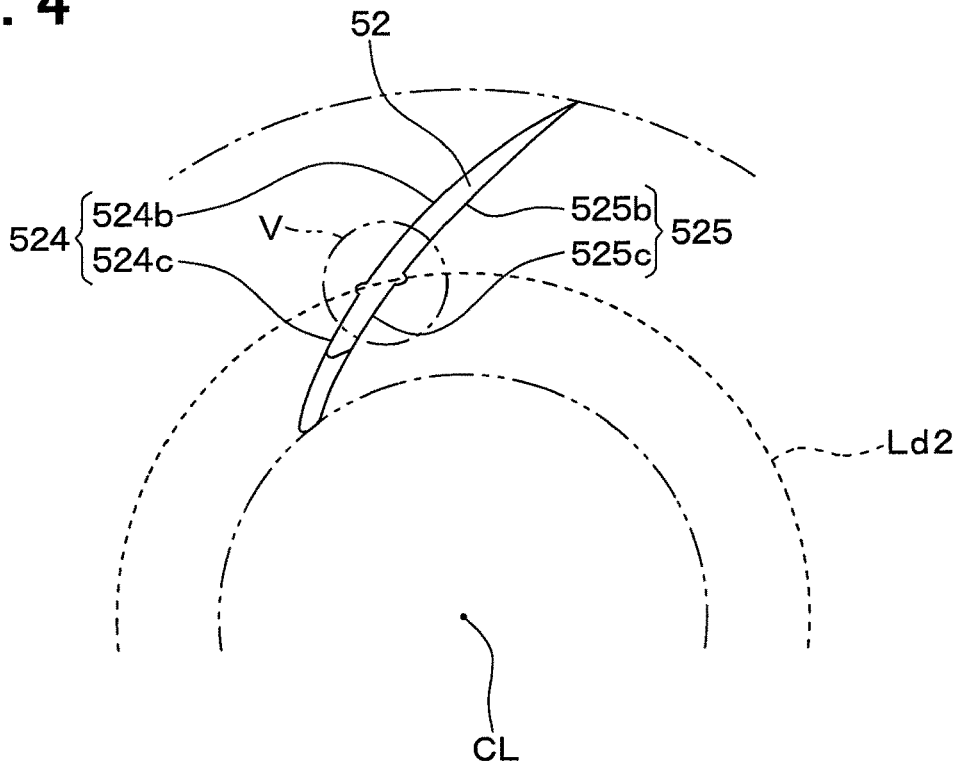
FIG. 4 is a view when one blade extracted from a turbofan is viewed from a fan axial center direction in the first embodiment.

In addition, as illustrated in FIG. 4, each of the multiple blades 52 has a positive pressure surface 524 and a negative pressure surface 525 that form a blade shape. In addition, as illustrated in FIG. 3, the multiple blades 52 form an inter-blade flow path 52*a* through which the air flows between the blades 52 adjacent to each other among the multiple blades 52. In other words, between the positive pressure surface 524 of one of the two adjacent blades 52 among the multiple blades 52 and the negative pressure surface 525 of the other one, the inter-blade flow path 52*a* is provided. In addition, in FIG. 4, a broken line Ld2 represents the outer shape of the fan hub portion 56.

Figure 5:
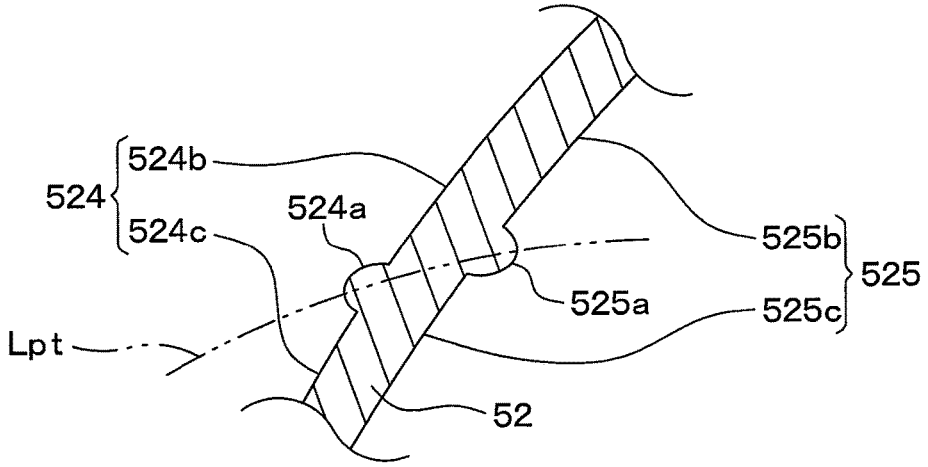
FIG. 5 is a cross-sectional view when a portion V of the blade illustrated in FIG. 4 is cut along a cross-section orthogonal to the fan axial center and viewed in the same direction as that in FIG. 4.

In addition, as illustrated in FIG. 5, each of the multiple blades 52 has a positive pressure surface protrusion portion 524*a* and a negative pressure surface protrusion portion 525*a*. The positive pressure surface protrusion portion 524*a* is a micro-protrusion provided in a protruded shape on the positive pressure surface 524. The negative pressure surface protrusion portion 525*a* is a micro-protrusion provided in a protruded shape on the negative pressure surface 525.

Figure 12:
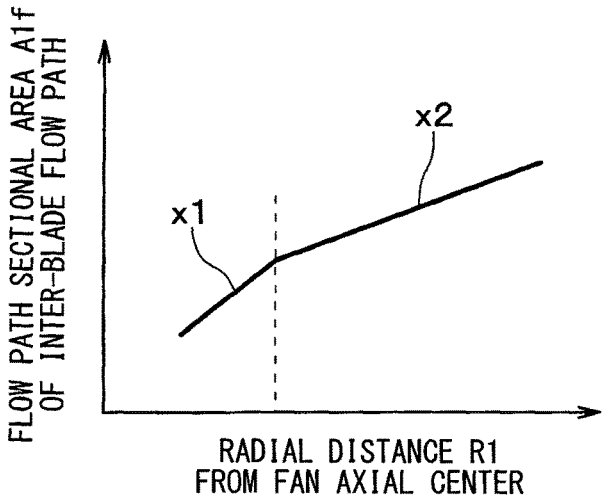
FIG. 12 is a graph illustrating a relationship between a radial distance from the fan axial center and a flow path cross-sectional area of the inter-blade flow path in the turbofan of the first embodiment.

The positive pressure surface protrusion portion 524*a* and the negative pressure surface protrusion portion 525*a* play a role of reducing the separation of the air flow caused by the discontinuous change of the flow path cross-sectional area A1*f* which will be described later with reference to FIG. 12. Here, the protrusion shape of the positive pressure surface protrusion portion 524*a*, for example, the protrusion height, is experimentally determined so as to prevent the separation of the air flow on the positive pressure surface 524. The same applies to the negative pressure surface protrusion portion 525*a*, and the protrusion shape of the negative pressure surface protrusion portion 525*a* is experimentally determined so as to restrict the separation of the air flow on the negative pressure surface 525.

Figure 8:
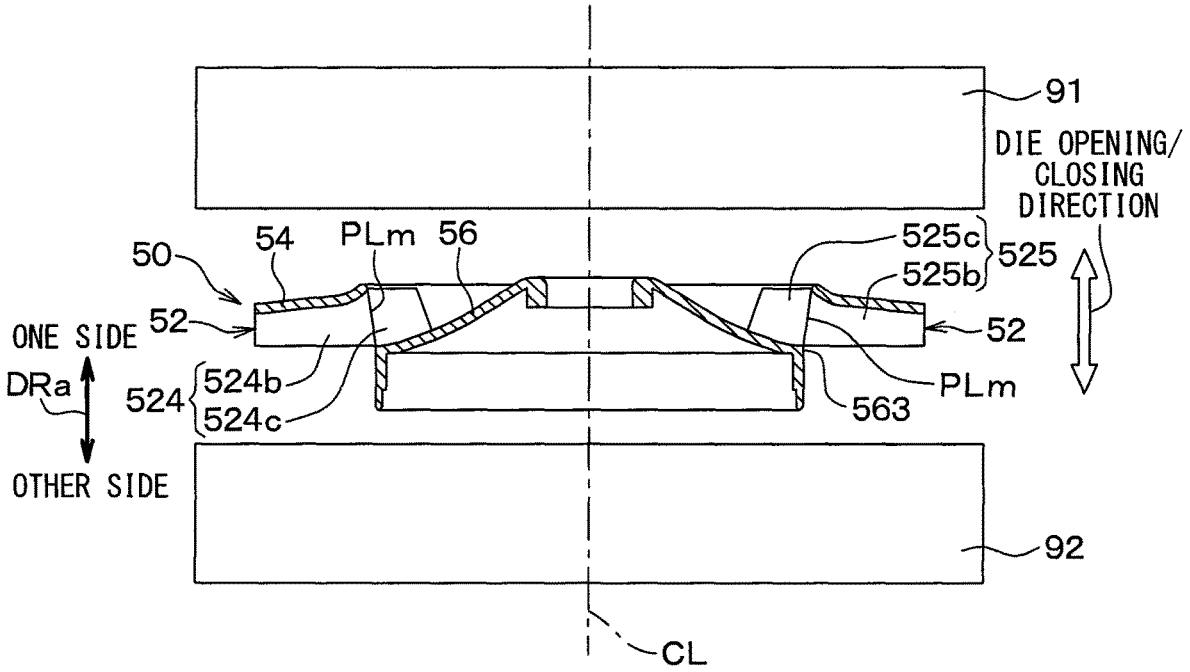
FIG. 8 is a schematic view illustrating a schematic configuration of a molding die for molding a fan main body member in the first embodiment.

Further, since the fan main body member 50 is integrally molded by injection molding, both of the positive pressure surface protrusion portion 524*a* and the negative pressure surface protrusion portion 525*a* are formed on a parting line Lpt between one side die 91 and an other side die 92 which form one pair of molding dies 91 and 92 used for the injection molding. The pair of molding dies 91 and 92 are illustrated in FIG. 8.

Figure 6:
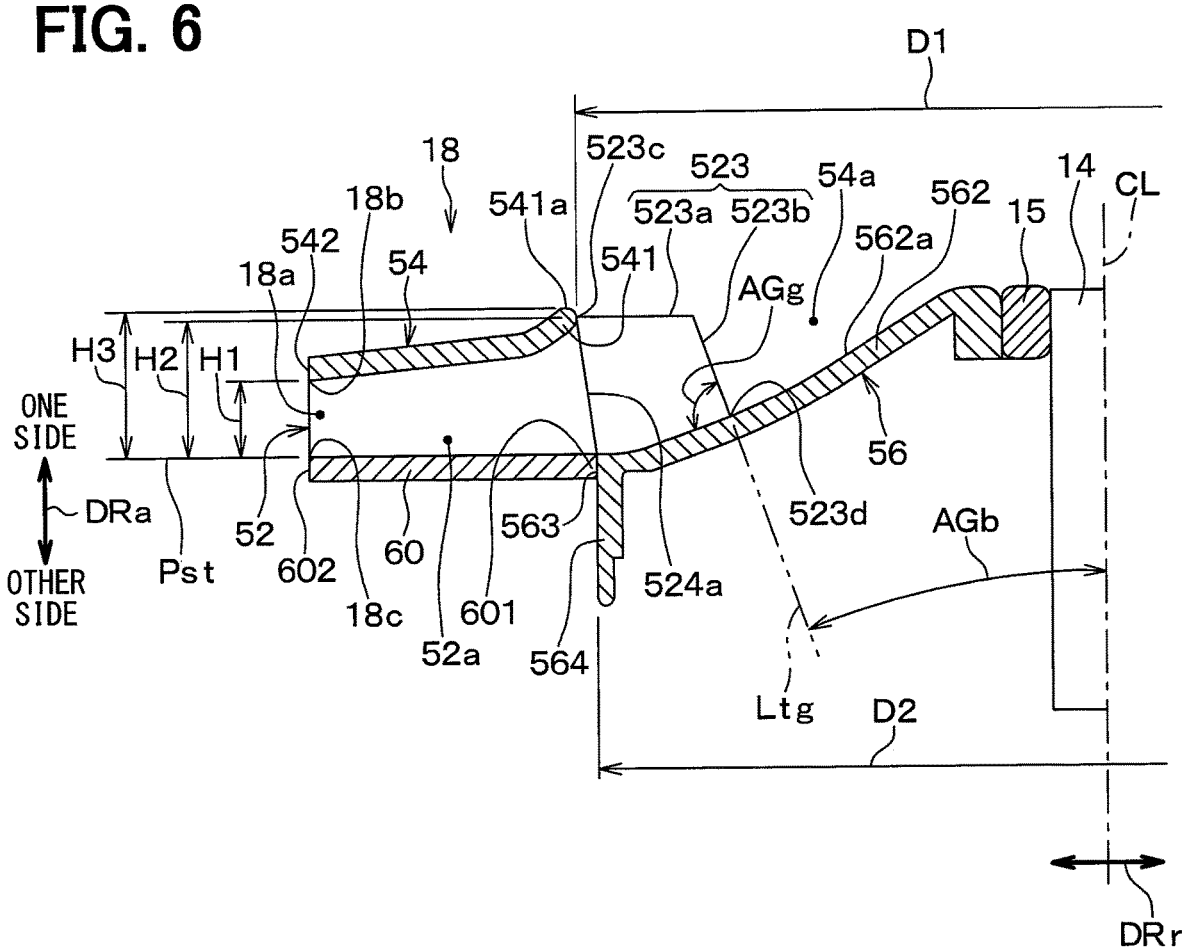
FIG. 6 is a view for describing the detailed shape of the turbofan of the first embodiment, and is a view in which the turbofan, the rotating shaft, and the rotating shaft housing are extracted from the cross-sectional view illustrating a left half of FIG. 2.

As illustrated in FIG. 6, the positive pressure surface protrusion portion 524*a* is provided so as to linearly extend from the ring inner circumferential end portion 541 to the hub outer circumferential end portion 563. This also applies to the negative pressure surface protrusion portion 525*a*. In other words, the negative pressure surface protrusion portion 525*a* is also provided to linearly extend from the ring inner circumferential end portion 541 to the hub outer circumferential end portion 563.

As illustrated in FIGS. 2 and 3, the shroud ring 54 has a shape which expands in a disk shape in the fan radial direction DRr. In addition, an intake hole 54*a* through which the air from the air suction port 221*a* of the casing 12 is suctioned as indicated by the arrow FLa is provided in the inner circumferential side of the shroud ring 54. Therefore, the shroud ring 54 has an annular shape.

Further, the shroud ring 54 has a ring inner circumferential end portion 541 and a ring outer circumferential end portion 542. The ring inner circumferential end portion 541 is an end portion provided on the inside of the shroud ring 54 in the fan radial direction DRr and forms the intake hole 54*a*. Further, the ring outer circumferential end portion 542 is an end portion provided on the outer side of the shroud ring 54 in the fan radial direction DRr.

Further, the shroud ring 54 is provided on one side in the fan axial center direction DRa, that is, on the air suction port 221*a* with respect to the multiple blades 52. At the same time, the shroud ring 54 is coupled to each of the multiple blades 52. In other words, the shroud ring 54 is coupled to each of the blades 52 in the one side blade end portion 521.

As illustrated in FIGS. 2 and 3, since the fan hub portion 56 is fixed via the rotating shaft housing 15 to the rotating shaft 14 rotatable about the fan axial center CL, the fan hub portion 56 is rotatably supported about the fan axial center CL with respect to the casing 12 that serves as a non-rotating member of the blower 10.

Further, the fan hub portion 56 is coupled to each of the multiple blades 52 on the side opposite to the shroud ring 54 side. Specifically, the entire blade coupling portion 561 coupled to the blade 52 in the fan hub portion 56 is provided on the inside of the entire shroud ring 54 in the fan radial direction DRr. In other words, the fan hub portion 56 is coupled to each of the blades 52 at a portion closer to the inner side in the fan radial direction DRr of the other side blade end portion 522. Therefore, since the multiple blades 52 also serve as a coupling rib for joining the fan hub portion 56 and the shroud ring 54 so as to bridge the fan hub portion 56 and the shroud ring 54, the multiple blades 52, the fan hub portion 56, and the shroud ring 54 can be integrally molded.

Further, the fan hub portion 56 has a hub guide surface 562*a* for guiding the air flow on the inside of the turbofan 18. The hub guide surface 562*a* is a curved surface that expands in the fan radial direction DRr and guides the air flow suctioned into the air suction port 221*a* and directed toward the fan axial center direction DRa so as to be directed outward in the fan radial direction DRr.

In other words, the fan hub portion 56 has a hub guide portion 562 having the hub guide surface 562*a*. In addition, the hub guide portion 562 forms the hub guide surface 562*a* on one side of the hub guide portion 562 in the fan axial center direction DRa.

In addition, in order to fix the fan hub portion 56 to the rotating shaft 14, an inner circumferential hole 56*a* which penetrates the fan hub portion 56 in the fan axial center direction DRa is provided on the inner circumferential side of the fan hub portion 56.

Further, the fan hub portion 56 has a hub outer circumferential end portion 563 and an annular extension portion 564. The hub outer circumferential end portion 563 is an end portion provided on the outer side of the fan hub portion 56 in the fan radial direction DRr. Specifically, the hub outer circumferential end portion 563 is an end portion that forms the circumferential edge of the hub guide portion 562.

The annular extension portion 564 is a cylindrical rib and extends from the hub outer circumferential end portion 563 to the other side in the fan axial center direction DRa (that is, the side opposite to the air suction port 221*a* side). The motor rotor 161 is fitted and stored on the inner circumferential side of the annular extension portion 564. In other words, the annular extension portion 564 functions as a rotor storage portion that stores the motor rotor 161. In addition, the annular extension portion 564 is fixed to the motor rotor 161, the fan hub portion 56 is fixed to the motor rotor 161.

The other end side plate 60 has a shape that expands in a disk shape in the fan radial direction DRr. In addition, a side plate fitting hole 60*a* which penetrates the other end side plate 60 in the thickness direction is provided on the inner circumferential side of the other end side plate 60. Therefore, the other end side plate 60 has an annular shape. The other end side plate 60 is, for example, a resin molded product molded separately from the fan main body member 50.

In addition, the other end side plate 60 is joined to each of the other side blade end portions 522 of the multiple blades 52 in a state of being fitted to the outer side of the fan hub portion 56 in the fan radial direction DRr. The other end side plate 60 and the blade 52 are joined to each other, for example, by vibration welding or thermal welding. Therefore, from the viewpoint of the weldability of the other end side plate 60 and the blade 52 by welding, it is preferable that the material of the other end side plate 60 and the fan main body member 50 is a thermoplastic resin, and more specifically, the same material is preferable.

By joining the other end side plate 60 to the blade 52 in this manner, the turbofan 18 is completed as a closed fan. The closed fan is a turbofan of which both sides in the fan axial center direction DRa of the inter-blade flow path 52*a* provided between the multiple blades 52 are covered with the shroud ring 54 and the other end side plate 60. In other words, the shroud ring 54 has a ring guide surface 543 which faces the inter-blade flow path 52*a* and guides the air flow in the inter-blade flow path 52*a*. In addition, the other end side plate 60 has a side plate guide surface 603 which faces the inter-blade flow path 52*a* and guides the air flow in the inter-blade flow path 52*a*.

The side plate guide surface 603 faces the ring guide surface 543 across the inter-blade flow path 52*a* and is disposed on the outer side in the fan radial direction DRr with respect to the hub guide surface 562*a*. In addition, the side plate guide surface 603 plays a role of smoothly leading the air flow along the hub guide surface 562*a* to the air outlet 18*a*. Therefore, each of the hub guide surface 562*a* and the side plate guide surface 603 forms a part and an other part of the virtual curved surface three-dimensionally curved. In other words, the hub guide surface 562*a* and the side plate guide surface 603 form one curved surface that is not bent at the boundary between the hub guide surface 562*a* and the side plate guide surface 603.

In addition, the other end side plate 60 has a side plate inner circumferential end portion 601 and a side plate outer circumferential end portion 602. The side plate inner circumferential end portion 601 is an end portion provided on the inner side of the other end side plate 60 in the fan radial direction DRr and forms a side plate fitting hole 60*a*. In addition, the side plate outer circumferential end portion 602 is an end portion provided on the outer side in the fan radial direction DRr of the other end side plate 60.

The side plate outer circumferential end portion 602 and the ring outer circumferential end portion 542 are disposed to be separated from each other in the fan axial center direction DRa. In addition, the side plate outer circumferential end portion 602 and the ring outer circumferential end portion 542 are provided by forming the air outlet 18*a* from which the air which passes through the inter-blade flow path 52*a* blows out between the side plate outer circumferential end portion 602 and the ring outer circumferential end portion 542.

Further, as illustrated in FIGS. 2 and 6, each of the multiple blades 52 has a blade front edge 523. The blade front edge 523 of the blade 52 is an end edge formed on the upstream side in an air flow direction of the air that passes through the air intake hole 54*a* and flows to the inter-blade flow path 52*a* between the blades 52, that is, in the air flow direction of the air that flows along the arrows FLa and FLb. The blade front edge 523 extends further inwardly in the fan radial direction DRr with respect to the ring inner circumferential end portion 541. In other words, the blade front edge 523 also extends further inwardly in the fan radial direction DRr with respect to the hub outer circumferential end portion 563.

Specifically, the blade front edge 523 includes two front edges 523*a* and 523*b*, that is, a first front edge 523*a* and a second front edge 523*b*. The first front edge 523*a* and the second front edge 523*b* are each provided to linearly extend, and the first front edge 523*a* and the second front edge 523*b* are coupled in series.

In addition, the first front edge 523*a* is connected to the ring inner circumferential end portion 541 of the shroud ring 54. In other words, the first front edge 523*a* has a ring side connection end 523*c* connected to the shroud ring. Meanwhile, the second front edge 523*b* is connected to the hub guide surface 562*a* of the fan hub portion 56. In other words, the second front edge 523*b* has a hub side connection end 523*d* connected to the fan hub portion 56.

As illustrated in FIGS. 2 and 3, the turbofan 18 configured in this manner rotates integrally with the motor rotor 161 in the fan rotation direction DRf. Along with this, the blade 52 of the turbofan 18 gives a momentum to the air, and the turbofan 18 blows out the air outward in the radial direction from the air outlet 18*a* open to the outer circumference of the turbofan 18. At this time, the air which is suctioned from the intake hole 54*a* and sent out by the blade 52, that is, the air blown out from the air outlet 18*a* is discharged to the outer side of the blower 10 via the air outlet 12*a* provided by the casing 12.

Here, the detailed shape of the turbofan 18 will be described by using FIG. 6. As illustrated in FIG. 6, in the fan main body member 50, an outer diameter D2 of the fan hub portion 56 is smaller than an inner diameter D1 of the shroud ring 54. In other words, the entire hub outer circumferential end portion 563 is disposed further on the inside than the ring inner circumferential end portion 541 in the fan radial direction DRr. In addition, the inner diameter D1 of the shroud ring 54 is the minimum inner diameter of the shroud ring 54, that is, the outer diameter of the intake hole 54*a*, and the outer diameter D2 of the fan hub portion 56 is the maximum outer diameter of the fan hub portion 56. In addition, in the present embodiment, the outer diameter of the annular extension portion 564 and the outer diameter of the hub outer circumferential end portion 563 are the same as each other and match the outer diameter D2 of the fan hub portion 56. In molding the fan main body member 50, the outer diameter of the annular extension portion 564 is preferably equal to or smaller than the outer diameter of the hub outer circumferential end portion 563.

In addition, in the fan axial center direction Dra, a height H2 from a predetermined reference position Pst to the ring side connection end 523*c* is larger than a height H1 from the reference position Pst to one end 18*b* positioned on one side of the fan axial center direction DRa of the air outlet 18*a*. At the same time, the height H2 to the ring side connection end 523*c* is smaller than a height H3 from the above-described reference position Pst to the end 541*a* on one side of the ring inner circumferential end portion 541 in the fan axial center direction DRa. In short, a relationship of "H1<H2<H3" is established.

In other words, the ring side connection end 523*c* is positioned further on one side in the fan axial center direction DRa than the one end 18*b* of the air outlet 18*a*. In addition, the ring side connection end 523*c* is positioned further on the other side in the fan axial center direction DRa than the end 541*a* on one side of the ring inner circumferential end portion 541 in the fan axial center direction DRa. In addition, in FIG. 6, the above-described reference position Pst is an other end 18*c* positioned on the other side of the fan axial center direction DRa of the air outlet 18*a*, but may be placed in any place.

In addition, when assuming a virtual tangent line Ltg which is in contact with the blade front edge 523 at the hub side connection end 523*d* of the blade front edge 523, the virtual tangent line Ltg is inclined with respect to the fan axial center CL such that one side of the virtual tangent line Ltg in the fan axial center direction DRa faces the outer side of the fan radial direction DRr. The blade front edge 523 is configured in this manner. In short, an angle AGb provided by the blade front edge 523 with respect to the fan axial center CL at the hub side connection end 523*d*, that is, an axial center angle AGb in FIG. 6, is "0°<AGb<90°" in a relationship with the fan axial center CL.

In addition, in the relationship between the blade front edge 523 and the hub guide surface 562*a*, an angle AGg provided by the blade front edge 523 with respect to the hub guide surface 562*a* at the hub side connection end 523*d*, that is, a countermeasure inner surface angle AGg of FIG. 6 which is provided on the outer side of the blade front edge 523 in the fan radial direction DRr is preferably equal to or larger than 70°. This is for smooth introduction of the air that flows along the hub guide surface 562*a* into the inter-blade flow path 52*a*. In addition, in the present embodiment, as illustrated in FIG. 6, the countermeasure inner surface angle AGg is 90°.

Figure 7:
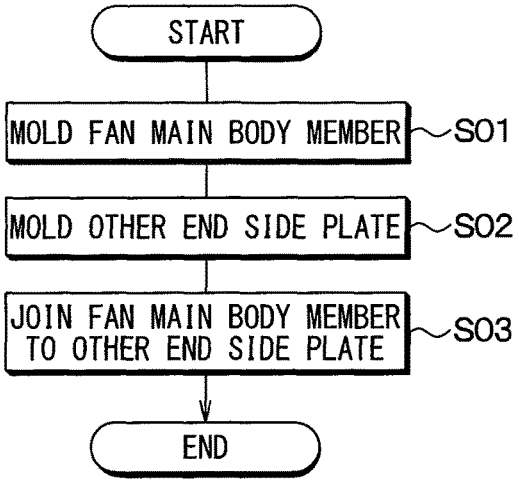
FIG. 7 is a flowchart illustrating a manufacturing process of the turbofan in the first embodiment.

Next, a method of manufacturing the turbofan 18 will be described with reference to the flowchart of FIG. 7. As illustrated in FIG. 7, first, in step S01 as a fan main body member molding step, molding of the fan main body member 50 is performed. In other words, multiple blades 52, the shroud ring 54, and the fan hub portion 56, which are component elements of the fan main body member 50, are integrally molded.

Specifically, as illustrated in FIG. 8, the multiple blades 52, the shroud ring 54, and the fan hub portion 56 are integrally molded by the injection molding in which one pair of molding dies 91 and 92 which open and close in the fan axial center direction Dra are used. The one pair of molding dies 91 and 92 are configured to include the one side die 91 and the other side die 92. In addition, the other side die 92 is a die provided on an other side of the one side die 91 in the fan axial center direction DRa.

In molding the fan main body member 50, a parting line trace PLm of the molding dies 91 and 92 is linearly provided on the positive pressure surface 524 and the negative pressure surface 525 of the blade 52. In other words, both of a positive pressure surface outer region 524*b* that occupies the outer side of the parting line trace PLm in the fan radial direction DRr of the positive pressure surface 524 and a negative pressure surface outer region 525*c* that occupies the outer side of the parting line trace PLm in the fan radial direction DRr of the negative pressure surface 525, are provided by the other side die 92. In addition, both of a positive pressure surface inner region 524*c* that occupies the inner side of the parting line trace PLm in the fan radial direction DRr of the positive pressure surface 524 and a negative pressure inner region 525*b* that occupies the inner side of the parting line trace PLm in the fan radial direction DRr of the negative pressure surface 525, are provided by the one side die 91.

In other words, the positive pressure surface outer region 524*b* is a region which is provided further on the outer side than the hub outer circumferential end portion 563 of the positive pressure surface 524 in the fan radial direction DRr. In addition, the positive pressure surface inner region 524*c* is a region which is provided further on the inside than the positive pressure surface outer region 524*b* of the positive pressure surface 524 in the fan radial direction DRr. Similarly, the negative pressure surface outer region 525*b* is a region which is provided further on the outer side than the hub outer circumferential end portion 563 of the negative pressure surface 525 in the fan radial direction DRr. In addition, the negative pressure surface inner region 525*c* is a region which is provided further on the inside than the negative pressure surface outer region 525*b* of the negative pressure surface 525 in the fan radial direction DRr.

In addition, the parting line trace PLm on the positive pressure surface 524 and the negative pressure surface 525 is provided so as to linearly extend from the ring inner circumferential end portion 541 to the hub outer circumferential end portion 563 illustrated in FIG. 2. In addition, both the positive pressure surface protrusion portion 524*a* and the negative pressure surface protrusion portion 525*a* which are illustrated in FIG. 5 extend along the parting line trace PLm of FIG. 8. In other words, the positive pressure surface protrusion portion 524*a* is provided by both of the one side die 91 and the other side die 92, and the negative pressure surface protrusion portion 525*a* is also provided by both of the one side die 91 and the other side die 92.

In the flowchart of FIG. 7, the process proceeds to step S02 after step S01. In step S02 as the other end side plate molding step, the molding of the other end side plate 60 is performed by, for example, injection molding. In addition, any of step S01 and step S02 may be executed first.

The process proceeds to step S03 after step S02. In step S03 as a joining step, the other end side plate 60 illustrated in FIG. 2 is fitted to the outer side in the radial direction of the fan hub portion 56. At the same time, the other end side plate 60 is joined to each of the other side blade end portions 522 of the blade 52. The blade 52 and the other end side plate 60 are joined to each other, for example, by vibration welding or thermal welding. By completing step S03, the turbofan 18 is completed.

As described above, according to the present embodiment, as illustrated in FIGS. 2 and 6, the multiple blades 52, the shroud ring 54, and the fan hub portion 56 are integrally provided, and the outer diameter D2 of the fan hub portion 56 is smaller than the inner diameter D1 of the shroud ring 54. Therefore, as illustrated in FIG. 8, the multiple blades 52, the shroud ring 54, and the fan hub portion 56 can be easily and integrally molded with the fan axial center direction DRa as an opening and closing direction of the molding dies 91 and 92.

In addition, the other end side plate 60 is joined to each of the other side blade end portions 522 of the multiple blades 52 in a state of being fitted to the radially outer side of the fan hub portion 56. Therefore, the turbofan 18 can be completed by assembling the other end side plate 60 to the fan main body member 50 after forming the fan main body member 50. In this manner, as a result of the integral molding of the shroud ring 54 and the fan hub portion 56, rotational shake of the shroud ring 54 with respect to the fan axial center CL when the turbofan 18 is rotated can be easily restricted as compared with the turbofan of Patent Literature 1.

Figure 9:
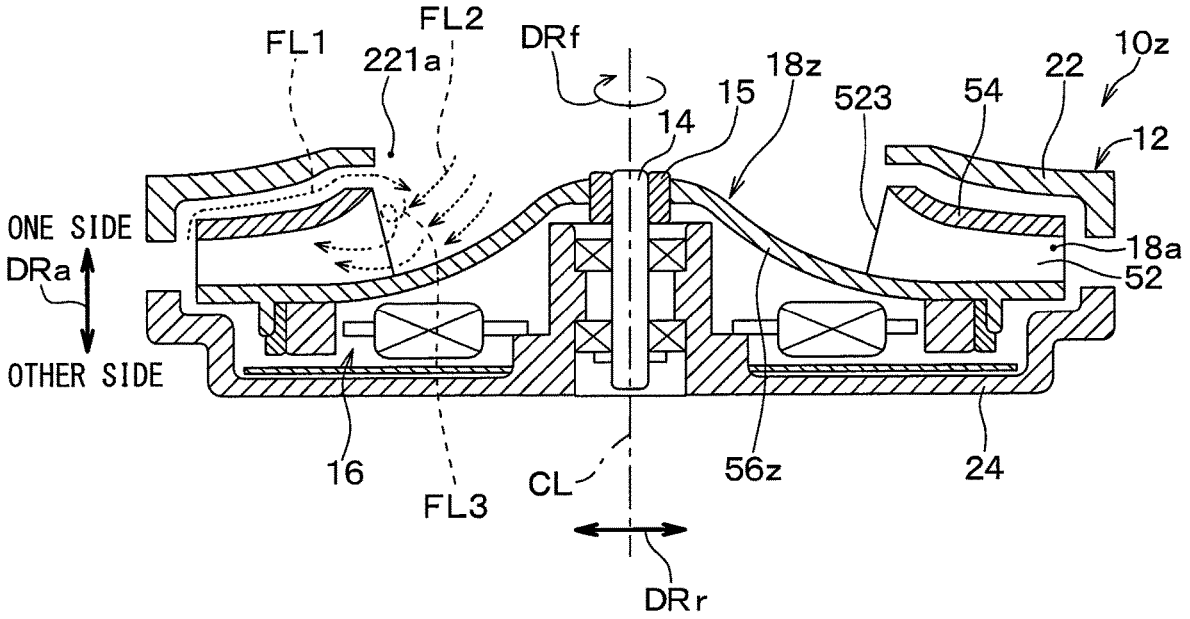
FIG. 9 is a view illustrating a comparative example to be compared with the first embodiment, and is a cross-sectional view that corresponds to FIG. 2 of the first embodiment.
Figure 10:
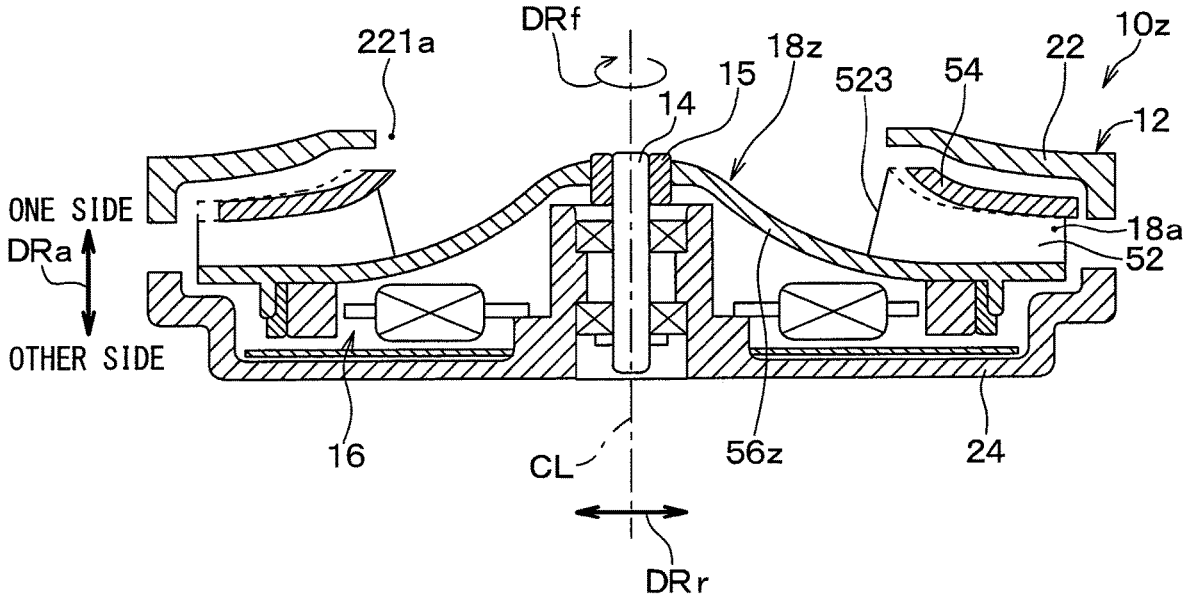
FIG. 10 is a view illustrating a comparative example to be compared with the first embodiment, and is a cross-sectional view illustrating a joining play of the shroud ring in FIG. 9.

As a result of restricting rotational shake of the shroud ring 54, the performance of the turbofan 18 can be improved. This will be described with reference to FIGS. 9 and 10. FIGS. 9 and 10 illustrate a turbofan 18*z* that serves as a comparative example to be compared with the present embodiment and a blower 10*z* having the same. The turbofan 18*z* of the comparative example is formed by joining the multiple blades 52, the shroud ring 54, and a main plate 56*z* after separately molding the multiple blades 52, the shroud ring 54, and the main plate 56*z*. The main plate 56*z* corresponds to one in which the fan hub portion 56 and the other end side plate 60 of the present embodiment are integrated.

As illustrated in FIG. 9, as one phenomenon generated in a general turbofan, there is a phenomenon in which the air backflows between the first case member 22 on the shroud ring 54 side of the casing 12 and the shroud ring 54 as indicated by an arrow FL1. As a cause of the backflow, a comparative example includes an example in which the air pressure at the blade front edge 523 of the turbofan 18*z* is larger on the negative pressure side with respect to the air pressure around the air outlet 18*a*.

For example, as the flow rate of the backflow air indicated by the arrow FL1 increases, the blown air volume of the turbofan 18*z* decreases. In addition, as the turbofan 18*z* rotates, the air flows from the air suction port 221*a* of the casing 12 to a space between the blades 52 of the turbofan 18*z* as indicated by an arrow FL2. In this regard, there is a concern that the backflow air flow of the arrow FL1 causes the air flow of the arrow FL2 to be separated from the shroud ring 54 as indicated by an arrow FL3 in the vicinity of the blade front edge 523 when the backflow air flow is merged with the air flow of the arrow FL2. The separation of the air flow causes, for example, noise. In this manner, since the backflow air causes the performance of the turbofan 18*z* to be impaired, it is necessary to reduce the flow rate of the backflow air as much as possible.

However, in the turbofan 18*z* of the comparative example, since the main plate 56*z* and the shroud ring 54 which are fitted to the rotating shaft 14 are separately molded, it is difficult to reduce the joining play (for example, misalignment) of the shroud ring 54 with respect to the main plate 56*z*. Therefore, in the turbofan 18*z*, rotational shake of the shroud ring 54 with respect to the rotating shaft 14 increases due to the joining play. In FIG. 10, the joining play of the shroud ring 54 in the fan radial direction DRr is displayed by superimposing the solid line and the broken line, however, naturally, the joining play of the shroud ring 54 is also generated in the fan axial center direction DRa.

In this manner, in the turbofan 18*z* of the comparative example, it is necessary to ensure a clearance between the shroud ring 54 and the first case member 22 which are illustrated in FIG. 9 to be large to some extent in order to accommodate rotational shake of the shroud ring 54. As a result, it has been difficult to reduce the flow rate of the backflow air that flows through the clearance.

Meanwhile, in the present embodiment, by integrally forming the multiple blades 52, the shroud ring 54, and the fan hub portion 56 which are illustrated in FIG. 2, in any of the fan radial direction DRr and the fan axial center direction DRa, rotational shake of the shroud ring 54 can be easily restricted. In addition, it is also possible to easily restrict variations in rotational deflection. Therefore, for example, as compared with the comparative example, the clearance between the shroud ring 54 and the first case member 22 can be reduced. In addition, by reducing the clearance, the flow rate of the backflow air that flows through the clearance can be reduced, and thus, fan performance indicated by the noise and airflow characteristics of the turbofan 18 can be improved.

In addition, according to the present embodiment, as illustrated in FIGS. 2 and 6, the blade front edge 523 extends further inwardly in the fan radial direction DRr than the ring inner circumferential end portion 541. Therefore, each of the multiple blades 52 can function as a coupling portion which couples the shroud ring 54 and the fan hub portion 56 to each other.

Here, the backflow air flow which flows backward through the gap (that is, clearance) between the first case member 22 and the shroud ring 54 is generated as described above along with the rotation of the turbofan 18. In addition, the backflow air flow is merged with the intake air flow that flows from the intake hole 54*a* to the inter-blade flow path 52*a* as indicated by the arrow FL2 in FIG. 11. In the present embodiment, the intake air flow can be accelerated by the blades 52 further on the upstream side than the merging position of the air flows.

Figure 11:
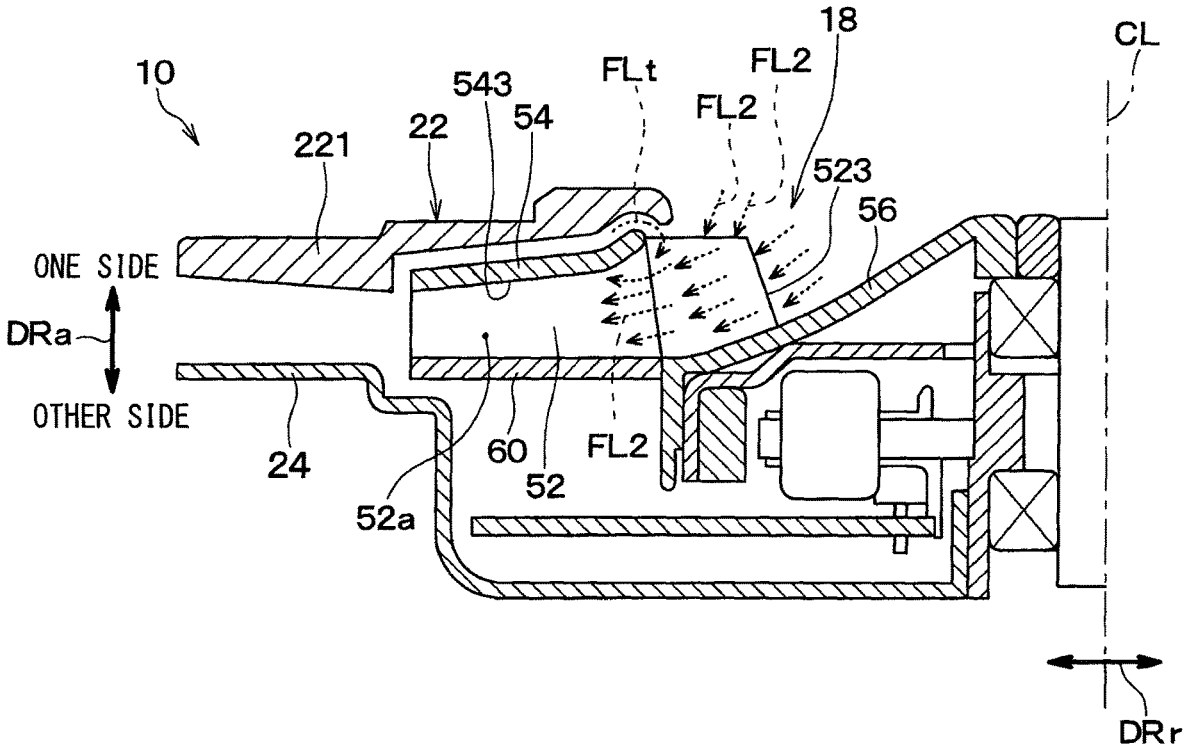
FIG. 11 is a view illustrating a state where a backflow air flow is merged with an intake air flow in the turbofan of the first embodiment.

Therefore, as indicated by an arrow FLt in FIG. 11, the backflow air flow which is merged with the intake air flow can be deflected along the ring guide surface 543 of the shroud ring 54. In other words, the separation of the air flow from the ring guide surface 543 due to the backflow air flow can be prevented, and fan performance indicated by, for example, the noise and air volume characteristics of the turbofan 18 can be improved.

Further, according to the present embodiment, as illustrated in FIG. 6, the ring side connection end 523*c* of the blade front edge 523 is positioned further on the one side in the fan axial center direction DRa than one end 18*b* positioned on one side in the fan axial center direction DRa in the air outlet 18*a*. Therefore, as compared with a configuration that does not have the positional relationship, the separation of the air flow from the ring guide surface 543 can further be prevented, and fan performance can be improved.

Further, according to the present embodiment, as illustrated in FIG. 6, the ring side connection end 523*c* of the blade front edge 523 is positioned further on the other side in the fan axial center direction DRa than an end 541*a* on one side of the ring inner circumferential end portion 541 in the fan axial center direction DRa. Therefore, as illustrated in FIG. 2, a bell mouth portion 221*b* can be disposed by utilizing the step from the end 541*a* of the ring inner circumferential end portion 541 in the fan axial center direction DRa to the blade front edge 523. Therefore, the fan performance of the turbofan 18 can be improved by increasing the air entrainment amount of the bell mouth portion 221*b*, and the size expansion of the blower 10 caused by the bell mouth portion 221*b* can be restricted.

Further, according to the present embodiment, as illustrated in FIG. 6, the blade front edge 523 is provided such that one side of the virtual tangent line Ltg which is in contact with the blade front edge 523 at the hub side connection end 523*d* extends toward the outer side of the fan radial direction DRr and the virtual tangent line Ltg is inclined with respect to the fan axial center CL. Therefore, as illustrated in FIG. 8, in molding in which the molding dies 91 and 92 are opened and closed in the die opening and closing direction along the fan axial center direction DRa, the blades 52 do not have an undercut shape and the fan main body member 50 can be easily molded.

Further, according to the present embodiment, as illustrated in FIGS. 5 and 6, each of the multiple blades 52 includes the positive pressure surface protrusion portion 524*a* provided in a protrusion shape on the positive pressure surface 524, and the negative pressure surface protrusion portion 525*a* provided in a protrusion shape on the negative pressure surface 525. In addition, the positive pressure surface protrusion portion 524*a* and the negative pressure surface protrusion portion 525*a* are provided so as to linearly extend from the ring inner circumferential end portion 541 to the hub outer circumferential end portion 563.

Here, in the turbofan 18 of the present embodiment, as described above, the blade front edge 523 extends further inwardly in the fan radial direction DRr than the ring inner circumferential end portion 541. Therefore, as illustrated in FIG. 12, a flow path cross-sectional area A1*f* of the inter-blade flow path 52*a* changes discontinuously at the radial position of the ring inner circumferential end portion 541 or in the vicinity thereof. In other words, in FIG. 12, a change gradient of the flow path cross-sectional area A1*f* of the inter-blade flow path 52*a* with respect to the radial distance R1 from the fan axial center CL changes stepwise at a connection point between a relation line x1 and a relation line x2.

Figure 13:
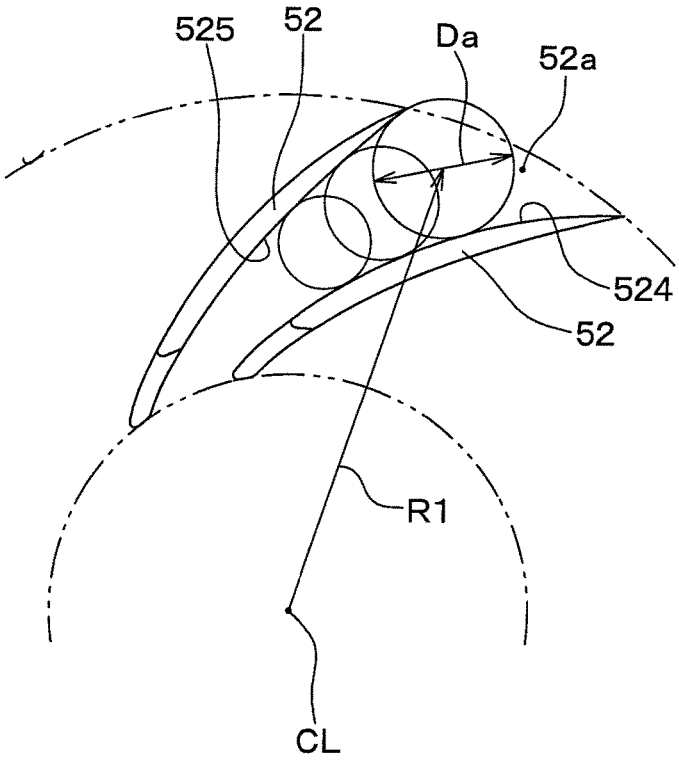
FIG. 13 is a view when one inter-blade flow path extracted from the turbofan is viewed from the fan axial center direction in the first embodiment.
Figure 14:
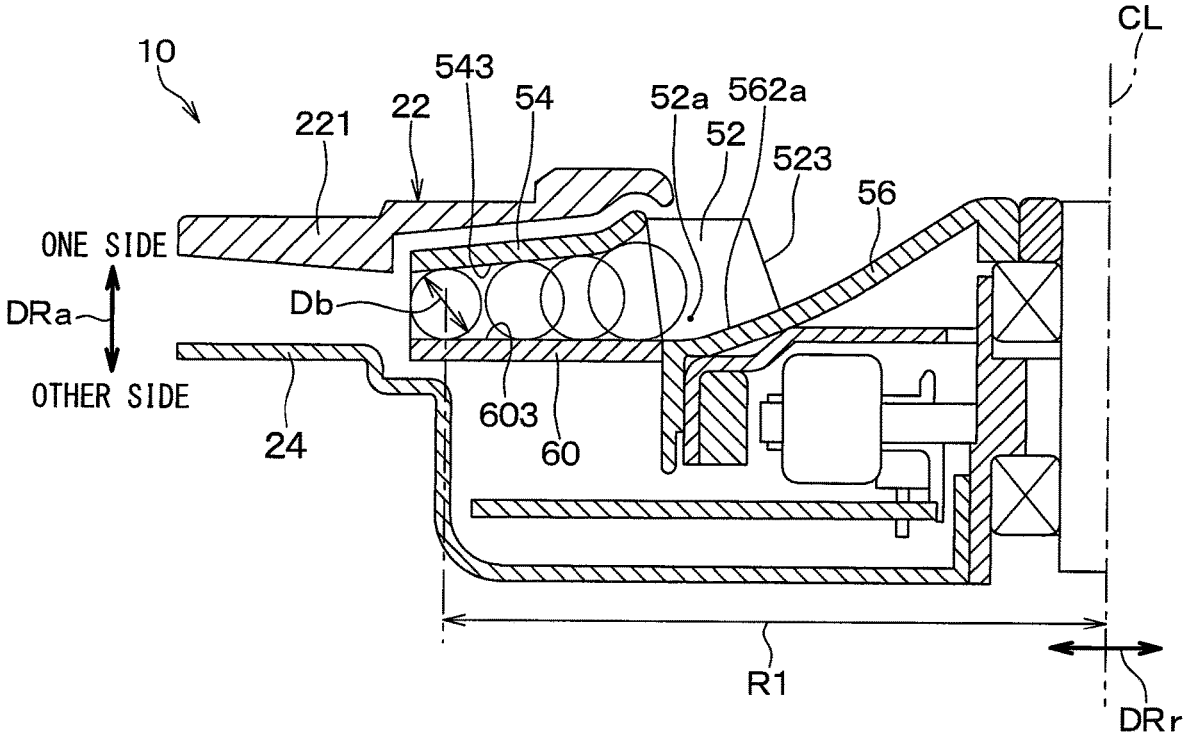
FIG. 14 is a cross-sectional view enlarging and displaying the inter-blade flow path of FIG. 2 in the first embodiment.

In addition, the flow path cross-sectional area A1*f* of the inter-blade flow path 52*a* is calculated as a product of a diameter Da of an inscribed circle of the inter-blade flow path 52*a* illustrated in FIG. 13 and a diameter Db of the inscribed circle of the inter-blade flow path 52*a* illustrated in FIG. 14. As illustrated in FIG. 13, the diameter Da is a diameter of an inscribed circle which is in contact with the positive pressure surface 524 and the negative pressure surface 525 of the blade 52 that faces the inter-blade flow path 52*a* in the cross-section orthogonal to the fan axial center CL. In addition, as illustrated in FIG. 14, the diameter Db is a diameter of the inscribed circle which is in contact with the ring guide surface 543 that faces the inter-blade flow path 52*a*, and the hub guide surface 562*a* or the side plate guide surface 603 in the cross-section including the fan axial center CL. In addition, the diameters Da and Db used to calculate the flow path cross-sectional area A1*f* are obtained after making the center position of the inscribed circle in FIG. 13 having the diameter Da and the center position of the inscribed circle in FIG. 14 having the diameter Db match each other in the fan radial direction DRr.

The discontinuous change in the above-described flow path cross-sectional area A1*f* causes the air flow separation from the positive pressure surface 524 or the negative pressure surface 525 of the blade 52, and can cause fan noise. Meanwhile, the positive pressure surface protrusion portion 524*a* and the negative pressure surface protrusion portion 525*a* which are illustrated in FIGS. 5 and 6 are provided at positions at which the flow path cross-sectional area A1*f* of the inter-blade flow path 52*a* changes discontinuously. In addition, by intentionally disturbing the air flow in the positive pressure surface protrusion portion 524*a* and the negative pressure surface protrusion portion 525*a*, an effect of preventing separation of the air flow from the positive pressure surface 524 and the negative pressure surface 525 can be obtained. As a result, there are effects, such as noise reduction of the turbofan, for example.

Further, according to the present embodiment, as illustrated in FIG. 2, the annular extension portion 564 of the fan hub portion 56 is fixed to the motor rotor 161 of the electric motor 16. Therefore, the fan hub portion 56 can be fixed to the motor rotor 161 without being influenced by the shape or the like of the other end side plate 60.

In addition, according to the present embodiment, as illustrated in FIGS. 2 and 7, after integrally molding the multiple blades 52, the shroud ring 54, and the fan hub portion 56, the other end side plate 60 having an annular shape is fitted to the radially outer side of the fan hub portion 56. At the same time, the other end side plate 60 is joined to each of the other side blade end portions 522 of the multiple blades 52. Therefore, rotational shake of the shroud ring 54 with respect to the fan axial center CL when the turbofan 18 is rotated can be easily restricted as compared with the turbofan of Patent Literature 1.

Further, according to the present embodiment, as illustrated in FIGS. 4 and 8, the positive pressure surface 524 of the blade 52 includes a positive pressure surface outer region 524*b* and a positive pressure surface inner region 524*c* provided further on the inside in the fan radial direction DRr than the positive pressure surface outer region 524*b*. Similarly, the negative pressure surface 525 of the blade 52 includes a negative pressure surface outer region 525*b* and a negative pressure surface inner region 525*c* provided further on the inside in the fan radial direction DRr than the negative pressure surface outer region 525*b*. In addition, both the positive pressure surface outer region 524*b* and the negative pressure surface outer region 525*b* are provided by the other side die 92 included in one pair of molding dies 91 and 92 that opens and is closed in the fan axial center direction DRa. In addition, both the positive pressure surface inner region 524*c* and the negative pressure surface inner region 525*c* are provided by the one side die 91 included in one pair of molding dies 91 and 92. Therefore, the shroud ring 54, the multiple blades 52, and the fan hub portion 56 can be integrally molded in a state where the shroud ring 54 is coupled to the fan hub portion 56 via each of the multiple blades 52.

Further, according to the present embodiment, as illustrated in FIG. 6, the outer diameter D2 of the fan hub portion 56 is smaller than the inner diameter D1 of the shroud ring 54. Therefore, an undercut shape on molding is not generated in the fan main body member 50, and a complicated die configuration is not required in the pair of molding dies 91 and 92 which are illustrated in FIG. 8. Therefore, for example, it is easy to reduce manufacturing costs.

OTHER EMBODIMENTS (1) In each of the above-described embodiments, the blade front edge 523 is configured such that the virtual tangent line Ltg in FIG. 6 which is in contact with the blade front edge 523 is inclined with respect to the fan axial center CL, but the virtual tangent line Ltg may be configured to be parallel to the fan axial center CL. In other words, since it is only necessary for the die for molding the fan main body member 50 to be pulled out in the fan axial center direction DRa, one side of the virtual tangent line Ltg in the fan axial center direction DRa with respect to the fan axial center CL may not be inclined so as to face the inside of the fan radial direction DRr.

Figure 15:
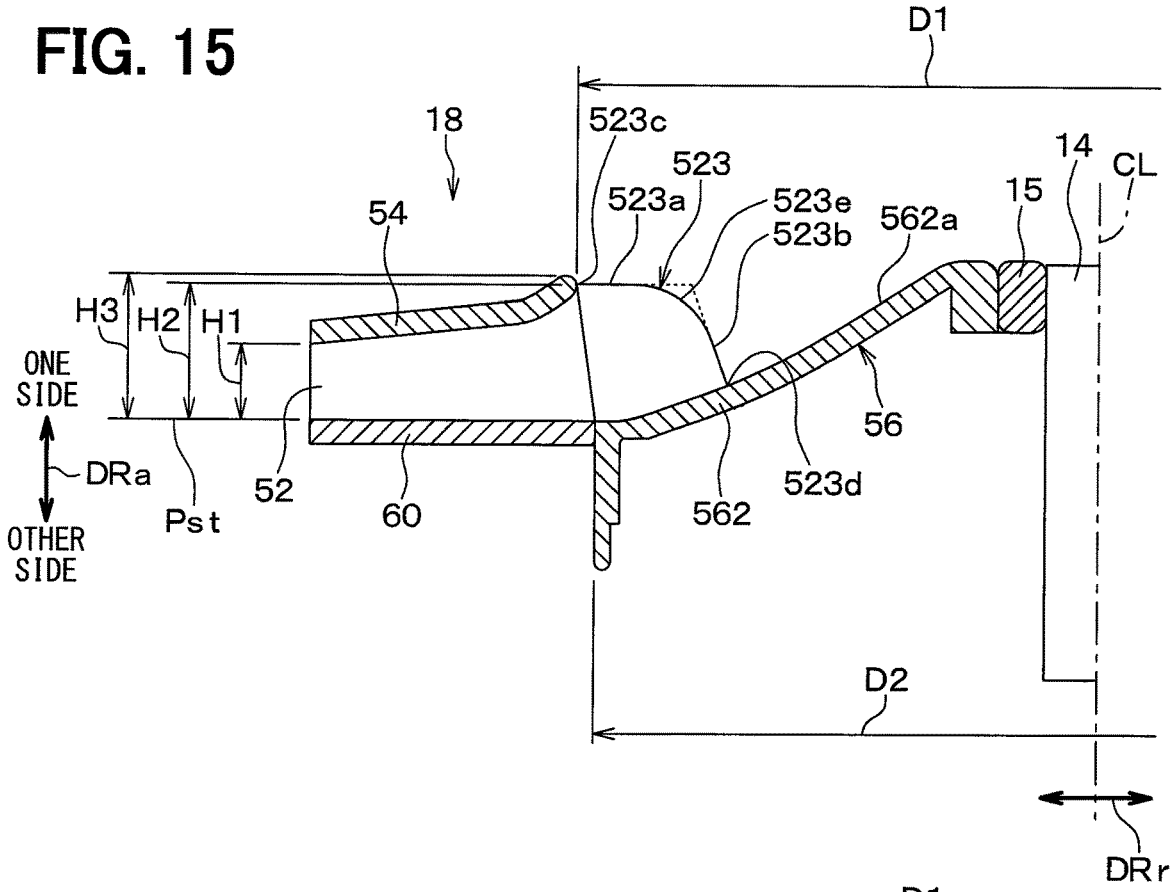
FIG. 15 is a cross-sectional view illustrating the shape of a blade front edge in a first modification based on the first embodiment, and is a view that corresponds to FIG. 6 of the first embodiment.

(2) In the above-described embodiment, the blade front edge 523 illustrated in FIG. 6 includes two linear first front edge 523*a* and second front edge 523*b*, and the blade front edge 523 is provided in a polygonal line shape, but the shape of the blade front edge 523 is not limited thereto. For example, as illustrated in FIG. 15, the first front edge 523*a* and the second front edge 523*b* may be coupled via an arc-shaped front edge 523*e*, and the blade front edge 523 may be provided in a single curved shape.

Figure 16:
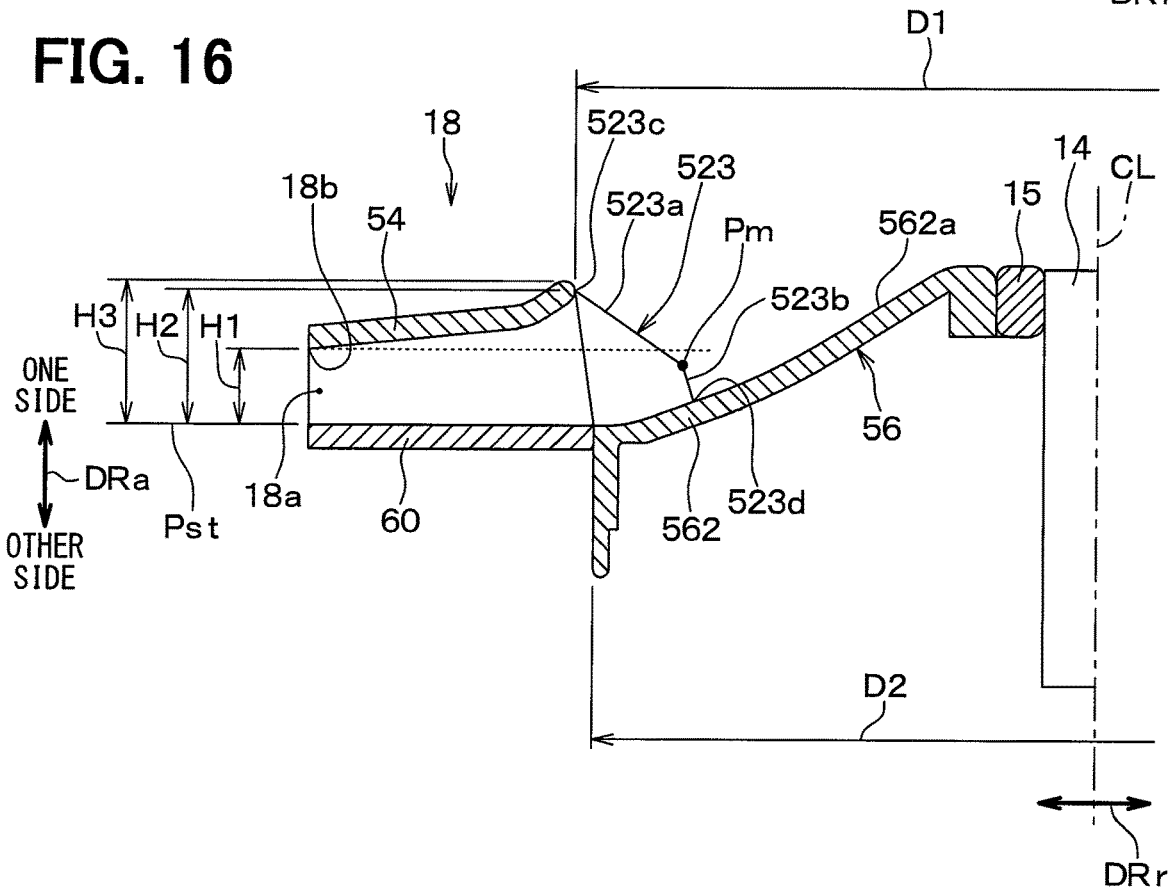
FIG. 16 is a cross-sectional view illustrating the shape of a blade front edge in a second modification based on the first embodiment, and is a view that corresponds to FIG. 6 of the first embodiment.

In addition, as illustrated in FIG. 16, the ring side connection end 523*c* of the blade front edge 523 is the same as that in FIG. 6, and the first front edge 523*a* may be inclined so as to be shifted to the other side in the fan axial center direction DRa as approaching the inner side in the fan radial direction DRr. In FIG. 16, for example, the height from the predetermined reference position Pst to an intersection Pm between the first front edge 523*a* and the second front edge 523*b* becomes equal to or less than the height H1 from the reference position Pst to the one end 18*b* of the air outlet 18*a*. In addition, in the example illustrated in FIG. 16 as well, as illustrated in FIG. 15, the arc-shaped front edge 523*e* is provided at the intersection Pm, and the first front edge 523*a* and the second front edge 523*b* may be coupled to each other via the arc-shaped front edge 523*e*.

Figure 17:
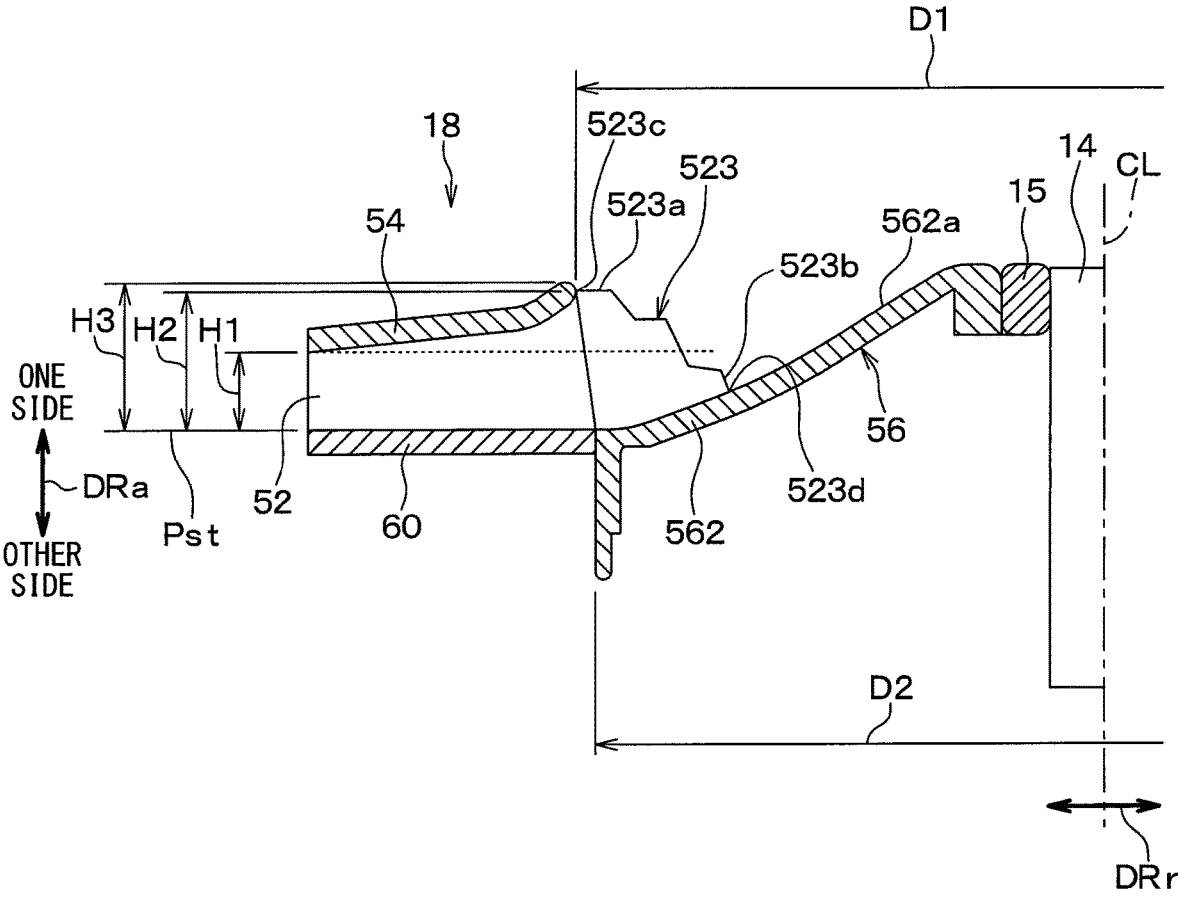
FIG. 17 is a cross-sectional view illustrating the shape of a blade front edge in a third modification based on the first embodiment, and is a view that corresponds to FIG. 6 of the first embodiment.

In addition, as illustrated in FIG. 17, the blade front edge 523 may be formed by making three or more straight or curved edge portions continuous to each other. In addition, in any of the examples of FIGS. 15 to 17, the relationship of "H1<H2<H3" is established.

(3) In the above-described embodiments, the electric motor 16 is an outer rotor type brushless DC motor, but the motor type thereof is not limited. For example, the electric motor 16 may be an inner rotor type motor or a brushed type motor.

(4) In the above-described embodiments, the positive pressure surface protrusion portion 524*a* and the negative pressure surface protrusion portion 525*a* of the blade 52 have a cross-sectional shape having an arc-shaped surface as illustrated in FIG. 5 in the cross-section orthogonal to the extending direction, but the cross-sectional shape of the positive pressure surface protrusion portion 524*a* and the negative pressure surface protrusion portion 525*a* is not limited. In addition, the cross-sectional shapes may be different from each other. For example, a slight step may be generated between the positive pressure surface outer region 524*b* and the positive pressure surface inner region 524*c* on the positive pressure surface 524 of the blade 52, and an exit angle of the step may be the positive pressure surface protrusion portion 524*a*. This also applies to the negative pressure surface protrusion portion 525*a*.

(5) In the above-described embodiments, as illustrated in FIG. 2, the annular extension portion 564 extends from the hub outer circumferential end portion 563 to the other side in the fan axial center direction DRa, but this is an example. For example, the annular extension portion 564 may extend from the portion further on the inside of the hub outer circumferential end portion 563 in the fan radial direction DRr to the other side in the fan axial center direction DRa. In addition, although the annular extension portion 564 is a cylindrical rib, the shape thereof is not limited. In addition, the fan hub portion 56 may not include the annular extension portion 564.

In addition, the present disclosure is not limited to the above-described embodiments. The present disclosure also encompasses various modifications or variations within the equivalent scope. In addition, in the above-described embodiments, it is needless to say that the elements which form the embodiment are not necessarily indispensable except in a case where the elements are clearly indispensable and a case where the elements are considered to be obviously indispensable in principle. In addition, in the above-described embodiments, when numerical values, such as the number, the numerical value, the quantity, the range, and the like of the component elements of the embodiment are mentioned, the values are not limited to a specific number except in a case where it is clearly stated that the values are particularly indispensable and in a case where the values are clearly limited to a specific number in principle. In addition, when referring to the materials, shapes, positional relationships, and the like of the component elements in the above-described embodiments, the material, the shape, the positional relationship, and the like are not limited except in a case where the values are particularly clearly stated and in a case where the values are limited to a specific material, shape, positional relationship, and the like in principle.

(Summary)

According to a first viewpoint described at a part or the entirety of the above-described embodiments, the multiple blades, the shroud ring, and the fan hub portion may be integrally formed, and the outer diameter of the fan hub portion may be smaller than the inner diameter of the shroud ring.

In addition, according to a second viewpoint, the blade front edge extends inwardly in the fan radial direction with respect to the ring inner circumferential end portion. Therefore, each of the multiple blades can function as a coupling portion which couples the shroud ring and the fan hub portion to each other.

Further, further on the upstream side than the merging position at which the backflow air flow which flows backward along the shroud ring on the outer side of the turbofan is merged with the intake air flow that flows into the space between the blades from the intake hole, the intake air flow can be accelerated by the blades. Therefore, the backflow air flow which is merged with the intake air flow can be deflected along the guide surface on the blade side of the shroud ring. In other words, the separation of the air flow from the guide surface of the shroud ring due to the backflow air flow can be prevented, and fan performance indicated by, for example, the noise and air volume characteristics of the turbofan can be improved.

In addition, according to a third viewpoint, the ring side connection end of the blade front edge is positioned further on one side in the axial direction than the one end positioned on one side in the axial direction in the air outlet. Therefore, as compared with a configuration that does not have the positional relationship, the separation of the air flow can further be prevented, and fan performance can be improved.

In addition, according to a fourth viewpoint, the ring side connection end of the blade front edge is positioned further on the other side in the axial direction than the end on one side of the ring inner circumferential end portion in the axial direction. Therefore, when the bell mouth portion is provided around the air suction port of the case for housing the turbofan, the bell mouth portion can be disposed by using the step from the end of the ring inner circumferential end portion in the axial direction to the blade front edge. Therefore, the fan performance of the turbofan can be improved by increasing the air entrainment amount of the bell mouth portion, and the size expansion of the blower caused by the bell mouth portion can also be restricted.

In addition, according to a fifth viewpoint, the blade front edge is formed such that the virtual tangent line which is in contact with the blade front edge at the hub side connection end is parallel to the fan axial center, or such that one side of the virtual tangent line extends toward the radially outer side and the virtual tangent line is inclined with respect to the fan axial center. Therefore, the blade does not have the undercut shape in molding by the die in the opening and closing direction along the axial direction of the fan axial center, and the fan main body member can be easily molded.

Further, according to a sixth viewpoint, each of the multiple blades includes the positive pressure surface protrusion portion provided in a protrusion shape on the positive pressure surface, and the negative pressure surface protrusion portion provided in a protrusion shape on the negative pressure surface. In addition, the positive pressure surface protrusion portion and the negative pressure surface protrusion portion are provided so as to linearly extend from the ring inner circumferential end portion to the hub outer circumferential end portion. Therefore, the positive pressure surface protrusion portion and the negative pressure surface protrusion portion are provided at positions at which the flow path cross-sectional area of the inter-blade flow path provided between the blades changes discontinuously. In addition, by intentionally disturbing the air flow in the positive pressure surface protrusion portion and the negative pressure surface protrusion portion, an effect of preventing separation of the air flow from the positive pressure surface and the negative pressure surface can be obtained. As a result, there are effects, such as noise reduction of the turbofan, for example.

Further, according to a seventh viewpoint, the annular extension portion of the fan hub portion is fixed to the rotor disposed on the inside of the annular extension portion included in the electric motor. Therefore, the fan hub portion can be fixed to the rotor of the electric motor without being influenced by the shape or the like of the other end side plate.

In addition, according to an eighth viewpoint, after integrally molding the multiple blades, the shroud ring, and the fan hub portion, the other end side plate having an annular shape is fitted to the radially outer side of the fan hub portion, and the other end side plates are joined to each of the other side blade end portions of the multiple blades.

In addition, according to a ninth viewpoint, both of the positive pressure surface outer region of the positive pressure surface of the blade and the negative pressure surface outer region of the negative pressure surface of the blade are provided by the other side die included in the pair of dies that open and close in the axial direction. In addition, both the positive pressure surface inner region provided further on the inside in the radial direction than the positive pressure surface outer region on the positive pressure surface and the negative pressure surface inner region provided further on the inside in the radial direction than the negative pressure surface outer region on the negative pressure surface, are also provided by the one side die included in the pair of dies. Therefore, the shroud ring, the multiple blades, and the fan hub portion can be integrally molded in a state where the shroud ring is coupled to the fan hub portion via each of the multiple blades.

What is claimed is:

1. A turbofan which is applied to a blower and which blows air while rotating about a fan axial center line, comprising:

a fan main body member including a plurality of blades disposed around the fan axial center line, a shroud ring having formed therein an intake hole into which air is suctioned, the shroud ring being provided on one side in an axial direction of the fan axial center line with respect to the plurality of blades and being coupled to each of the plurality of blades, and a fan hub portion which is supported so as to be rotatable about the fan axial center line with respect to a non-rotating member of the blower and which is coupled to each of the plurality of blades on a side opposite from the shroud ring side; and an other end side plate that, in a state of being fitted to a radially outer side of the fan hub portion, is joined to an other side blade end portion included in each of the plurality of blades, the other side blade end portions of the plurality of blades being on an other side which is opposite to the one side in the axial direction, wherein an outer diameter of the fan hub portion is smaller than an inner diameter of the shroud ring, the plurality of blades, the shroud ring, and the fan hub portion are integrally formed, the fan hub portion includes a hub outer circumferential end portion provided on the outer side of the fan hub portion in the radial direction, and an annular extension portion which extends toward the other side in the axial direction, the annular extension portion having an annular shape, the other end side plate and the hub outer circumferential end portion are separately formed from each other and the other end side plate is in contact with the hub outer circumferential end portion, the annular extension portion is configured to protrude from both the other end side plate and the hub outer circumferential end portion at a connecting portion between the other end side plate and the hub outer circumferential end portion toward the other side in the axial direction, the shroud ring has a ring inner circumferential edge and a ring outer circumferential edge which forms the intake hole, the ring inner circumferential edge is on an inner side in a radial direction of the fan axial center line, each of the plurality of blades includes a blade front edge on an upstream side in an air flow direction of the air which passes through the intake hole and flows between the plurality of blades, the blade front edge extends further inwardly in the radial direction with respect to the ring inner circumferential edge, each of the plurality of blades has a positive pressure surface, a negative pressure surface, a positive pressure surface protrusion portion provided in a protruded shape on the positive pressure surface, a negative pressure surface protrusion portion provided in a protruded shape on the negative pressure surface, and the positive pressure surface protrusion portion and the negative pressure surface protrusion portion are provided so as to linearly extend from the ring inner circumferential edge to the hub outer circumferential end portion.

2. The turbofan according to claim 1, wherein the ring outer circumferential edge of the shroud ring is located on an outer side in the radial direction, the other end side plate has a side plate outer circumferential end portion on the outer side in the radial direction, the ring outer circumferential edge and the side plate outer circumferential end portion are disposed so as to be separated from each other along the axial direction, and an air outlet for blowing out the air formed between the ring outer circumferential edge and the side plate outer circumferential end portion, the blade front edge has a ring side connection end connected to the shroud ring, and the ring side connection end is positioned further toward the one side in the axial direction than one opening portion of the air outlet positioned on the one side in the axial direction.

3. The turbofan according to claim 2, wherein the ring inner circumferential edge has a first end toward the one side of the axial direction, and the ring side connection end of the blade front edge is positioned further toward the other side in the axial direction than the first end of the ring inner circumferential edge.

4. The turbofan according to claim 2, wherein the blade front edge includes a hub side connection end connected to the fan hub portion, and a virtual tangent line, which is in contact with the blade front edge at the hub side connection end, is configured so as to be parallel to the fan axial center line, or configured so as to be inclined with respect to the fan axial center line such that the virtual tangent line inclines away from the fan axial center line toward the one side of the axial direction.

5. The turbofan according to claim 1, wherein the annular extension portion is fixed to a rotor of an electric motor which rotates the fan hub portion, the rotor being disposed on an inside of the annular extension portion.

6. The turbofan according to claim 1, wherein the annular extension portion of the fan hub portion extends below a lower surface of the other end side plate in a vertical direction.

7. The turbofan according to claim 6, wherein the annular extension portion is fixedly attached to a rotor of an electric motor which rotates the fan hub portion, the rotor being disposed on an inside of the annular extension portion.

8. The turbofan according to claim 6, wherein the annular extension portion of the fan hub portion extending below the lower surface of the other end side plate in a vertical direction includes a single annular extension portion.

* * * * *